US012312872B2

(12) United States Patent
Brown et al.

(10) Patent No.: US 12,312,872 B2
(45) Date of Patent: May 27, 2025

(54) REMOTE CONTROL LINE CLAMP INSTALLATION SYSTEM

(71) Applicant: Frank's International, LLC, Houston, TX (US)

(72) Inventors: Dougal Brown, Scotland (GB); Paul Dupuis, Houston, TX (US)

(73) Assignee: FRANK'S INTERNATIONAL, LLC, Houston, TX (US)

( * ) Notice: Subject to any disclaimer, the term of this patent is extended or adjusted under 35 U.S.C. 154(b) by 0 days.

(21) Appl. No.: 18/430,930

(22) Filed: Feb. 2, 2024

(65) Prior Publication Data

US 2024/0271492 A1 Aug. 15, 2024

Related U.S. Application Data

(60) Provisional application No. 63/484,267, filed on Feb. 10, 2023.

(51) Int. Cl.

| | |
|---|---|
| ***E21B 17/02*** | (2006.01) |
| ***E21B 17/10*** | (2006.01) |
| ***E21B 19/08*** | (2006.01) |

(52) U.S. Cl.

CPC ..... *E21B 17/026* (2013.01); *E21B 19/08* (2013.01); *E21B 17/02* (2013.01); *E21B 17/1057* (2013.01)

(58) Field of Classification Search

CPC .... E21B 17/026; E21B 19/08; E21B 17/1057; E21B 17/1035; E21B 17/023

See application file for complete search history.

(56) References Cited

U.S. PATENT DOCUMENTS

| | | | | |
|---|---|---|---|---|
| 8,191,641 | B2 | 6/2012 | Boutwell, Jr. et al. | |
| 10,197,190 | B1 * | 2/2019 | Neff | E21B 17/1035 |
| 11,248,422 | B2 * | 2/2022 | Bergeron | E21B 23/12 |
| 2005/0161227 | A1 * | 7/2005 | Hayes | E21B 19/20 166/380 |

(Continued)

FOREIGN PATENT DOCUMENTS

| | | | | |
|---|---|---|---|---|
| GB | 2591027 A * | 7/2021 | | E21B 17/026 |
| NO | 20220040 A1 | 12/2022 | | |

(Continued)

OTHER PUBLICATIONS

GB Combined Search and Examination Report dated Jun. 17, 2024, GB Application No. 2401582.8 7 pages.

(Continued)

*Primary Examiner* — Robert E Fuller

(74) *Attorney, Agent, or Firm* — MH2 Technology Law Group, LLP

(57) ABSTRACT

A clamp installation system includes a clamp head configured to engage a top section and a bottom section of an axially-retained control line clamp. The clamp installation system also includes a manipulator assembly configured to bring the clamp head close to and away from a tubular string run into a well. The clamp head is configured to position the top and bottom sections of the axially-retained control line clamp on opposite axial sides of a coupling of the tubular string. The clamp head is configured to drive the top and bottom sections of the axially-retained control line clamp axially-together so as to secure the axially-retained control line clamp to the coupling.

20 Claims, 23 Drawing Sheets

(56) References Cited

U.S. PATENT DOCUMENTS

| | | | | |
|---|---|---|---|---|
| 2006/0006640 | A1* | 1/2006 | Knight | E21B 17/1035 285/81 |
| 2006/0090901 | A1* | 5/2006 | Pennison | E21B 17/026 166/77.1 |
| 2007/0158079 | A1* | 7/2007 | Webre | E21B 19/10 166/380 |
| 2008/0308281 | A1 | 12/2008 | Boutwell, Jr. et al. | |
| 2012/0211217 | A1 | 8/2012 | Boutwell, Jr. et al. | |
| 2013/0186640 | A1* | 7/2013 | Webre | E21B 19/08 166/85.5 |
| 2018/0148983 | A1 | 5/2018 | Hagen | |
| 2021/0215005 | A1* | 7/2021 | Jahn | E21B 17/026 |

FOREIGN PATENT DOCUMENTS

| | | | |
|---|---|---|---|
| WO | 2009022912 | A1 | 2/2009 |
| WO | 2018097735 | A1 | 5/2018 |

OTHER PUBLICATIONS

Extended European Search Report dated May 10, 2024, GB Application No. 24156924.3, 7 pages.

* cited by examiner

REMOTE CONTROL LINE CLAMP INSTALLATION SYSTEM

CROSS-REFERENCE TO RELATED APPLICATIONS

This application claims priority to U.S. Provisional Patent Application No. 63/484,267, filed on Feb. 10, 2023, which is incorporated by reference.

BACKGROUND

Oil and gas wells may be equipped with control lines for mechanically, electrically, pneumatically, hydraulically, or optically linking various downhole devices to the surface. Control lines may be used to receive data from downhole instruments or to operate downhole devices such as valves, switches, sensors, relays, or other devices. For example, control lines may be used to open, close, or adjust downhole valves in order to selectively produce or isolate formations at locations deep in the well. A control line may transmit data gathered downhole to the surface or communicate commands to downhole devices to take samples, readings, or to stroke valves. Control lines may include electrically conductive wires or cables, optical fibers, or fluid conduits for pneumatically or hydraulically controlling downhole devices or transmitting data.

Control lines generally have a small diameter relative to the diameter of the pipe string to which they are secured. For example, an individual control line may be between 0.5 cm and 6 cm in diameter. However, multiple control lines may be aggregated to form an umbilical having a diameter of up to 10 cm or more.

Control lines are generally secured along the length of the outer surface of a pipe string, generally parallel to the center axis of the bore of the pipe string. Continuous control lines are secured to the pipe string using control line clamps at intervals along the string. The control line and the clamps may be installed while joints of pipe are made up into a pipe string and run into a well.

Most control line clamps are "wrap-around" style clamps, which are connected to the tubular by encircling the tubular. Typically, two semi-circular sections are joined together using fasteners (e.g., bolts and nuts) at their circumferential ends to form the wrap-around control line clamp.

Recently, axially-retained control line clamps have been proposed. These clamps are semicircular and extend around a portion of the outer diameter surface of the tubular, but do not fully encircle the tubular. Such clamps may be secured by causing two axial sections to grip a coupling that connects two tubulars of the pipe string together. For example, the axially-retained control line clamps may have a lip or another securing feature that fits into the small gap existing between the coupling and the tubular body at the upper and lower faces of the coupling. Such features provide the axial and radial support to retain the control line clamp onto the tubular.

While the axially-retained control line clamps may facilitate installation by not requiring two halves that encircle the tubular, the axially-retained control line clamps generally require a human operator to be present at well center to drive the two axial sections into a secure position onto the coupling.

SUMMARY

The accompanying drawing, which is incorporated in and constitutes a part of this specification, illustrates an embodiment of the present teachings and together with the description, serves to explain the principles of the present teachings. In the figures:

A clamp installation system is disclosed. The clamp installation system includes a clamp head configured to engage a top section and a bottom section of an axially-retained control line clamp. The clamp installation system also includes a manipulator assembly configured to bring the clamp head close to and away from a tubular string run into a well. The clamp head is configured to position the top and bottom sections of the axially-retained control line clamp on opposite axial sides of a coupling of the tubular string. The clamp head is configured to drive the top and bottom sections of the axially-retained control line clamp axially-together so as to secure the axially-retained control line clamp to the coupling.

A method is also disclosed. The method includes receiving a clamp into a clamp head of a clamp installation assembly. The method also includes moving the clamp head into proximity of a tubular string having a coupling between two tubulars. The method also includes pressing the clamp into engagement with the tubular string using the clamp installation assembly. The clamp includes first and second sections that are initially separated axially apart. When pressed into engagement with the tubular, the first and second sections are at least partially on opposite axial sides of the coupling. The method also includes driving the first and second sections of the clamp toward one another using the clamp head. The method also includes releasing the clamp from the clamp head. The method also includes moving the clamp head away from the tubular string.

A method for installing a clamp is also disclosed. The method includes actuating a device into a first position. A clamp installation assembly of the device faces away from a tubular string when the device is in the first position. The method also includes running the tubular string into a wellbore. The tubular string is run while the device is in the first position. The method also includes deploying a control line along the tubular string using a control line manipulating arm. A coupling connects adjacent tubulars of the tubular string together. The control line runs along and past the coupling. The method also includes loading the clamp into a clamp head of the clamp installation assembly. The method also includes actuating the device from the first position into a second position. The method also includes actuating the device from the second position into a third position. The method also includes moving the clamp head vertically along the tubular string to at least partially align the clamp head with the coupling. The method also includes actuating a draw actuator of the clamp installation assembly. Actuating the draw actuator includes retracting the draw actuator, which causes the draw actuator to engage the tubular string. The method also includes securing the clamp onto the coupling, wherein the clamp is secured by adducting two sections of the clamp head together. The method also includes moving the clamp installation assembly away from the tubular string once the clamp is secured to the coupling.

BRIEF DESCRIPTION OF THE DRAWINGS

The accompanying drawing, which is incorporated in and constitutes a part of this specification, illustrates an embodiment of the present teachings and together with the description, serves to explain the principles of the present teachings. In the figures.

Figure 1:
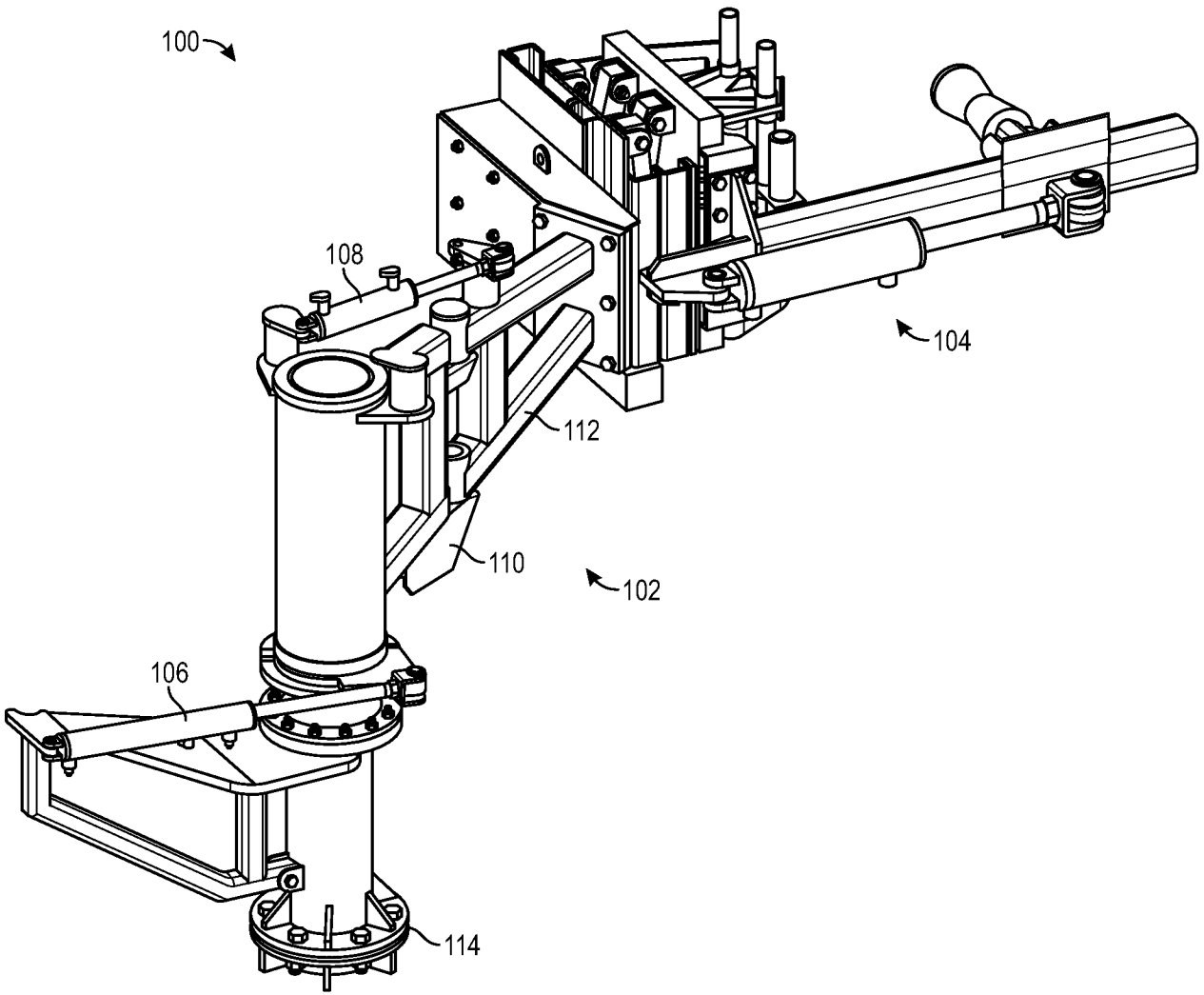
FIG. 1 illustrates a perspective view of a control line clamp installation device, according to an embodiment.

It should be noted that some details of the figure have been simplified and are drawn to facilitate understanding of the embodiments rather than to maintain strict structural accuracy, detail, and scale.

DETAILED DESCRIPTION

Embodiments of the present disclosure may provide a remote control line clamp installation device and method, e.g., which may be easily configured for use with any of the various types of axially-retained control line clamps. With introduction of the present remote installation device, human operators may be removed from close proximity to the well center and thus from exposure to the dangers of the equipment operating in that area of the rig floor. Further, at least some embodiments of the system and method may reduce the installation time by the introduction of mechanization to deliver the control line clamp along with the clamp securing apparatus to well center, and to install the clamp onto the tubular string, which may avoid worker fatigue.

In some embodiments, a manipulator arm assembly may be used to maneuver a control line clamp head to and from well center. The manipulator arm assembly may allow for a worker to load a control line clamp into the clamp head while in a safe location, away from well center. Once loaded, the manipulator arm assembly may move the clamp head to an installation position. Once the clamp has been installed, the manipulator arm assembly may return the clamp head to its loading position, a safe location away from well center. Further, the clamp head may be interchangeable depending on the design of the control line clamp being installed.

Reference will now be made in detail to embodiments of the present teachings, examples of which are illustrated in the accompanying drawing. In the drawings, like reference numerals have been used throughout to designate identical elements, where convenient. The following description is merely a representative example of such teachings.

FIG. 1 illustrates a perspective view of a remote, control line clamp installation device 100 (hereinafter, "the device" 100), according to an embodiment. The device 100 generally includes a manipulator arm assembly 102 and a clamp installation assembly 104. The manipulator arm assembly 102 may generally be configured to swing the clamp installation assembly 104 from a loading position (not shown) that is away from the well center, to an installation position (illustrated) that is at or proximal to well center, as will be described in greater detail below. Accordingly, the manipulator arm assembly 102 may include one or more actuators (two shown: 106, 108) and, e.g., one or more pivotable arms (two shown: 110, 112), which together may form a hinged boom. Further, in the illustrated embodiment, the pivotable arm 110 may be connected to a base 114 that is connected to the rig floor, a control line running device, or another, relatively stationary structure. The arm 112 may be coupled to and extend from the arm 110, and may be coupled to the clamp installation assembly 104. The actuator 106 may be configured to pivot the arm 110, and thereby pivot the arm 112, while the actuator 108 may be configured to pivot the arm 112 relative to the arm 110.

Figure 2:
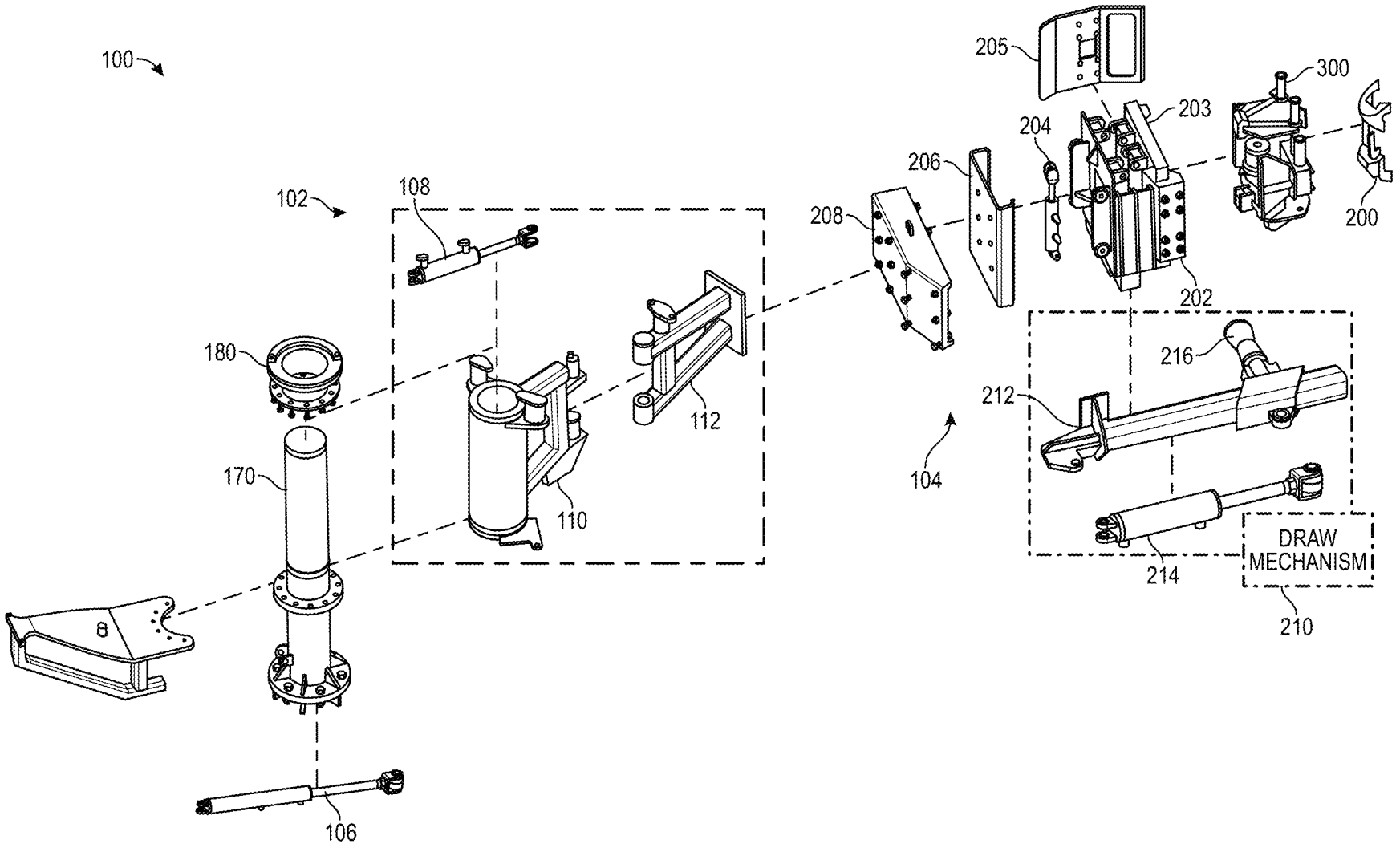
FIG. 2 illustrates an exploded view of the installation device, according to an embodiment.

The clamp installation assembly 104 may include components configured to (1) engage and hold an axially-retained clamp, (2) position the axially-retained clamp against a tubular string, such that axial sections of the clamp straddle a coupling between two tubulars of the string, and/or (3) fasten the axial sections together. FIG. 2 illustrates an exploded view of the device 100, including the components of the manipulator assembly 102, as well as components of the clamp installation assembly 104, according to an embodiment. The manipulator arm assembly 102, in addition to the components mentioned above, may include a post 170 about which the arm 110 is pivotable. The assembly 102 may additionally include a stop bushing 180 receivable on the post 170, which may provide an end range for the pivoting of the arm 110. Referring specifically to the components of the clamp installation assembly 104, such components may include a clamp head 300 (as will be described in greater detail below), a scissor assembly 202 (including a base plate 203), a vertical adjustment actuator/cylinder 204, a cable guard 205, a scissor assembly attachment plate 206, an alignment bracket 208, and a draw mechanism 210.

In some embodiments, the draw mechanism 210 may include a draw arm 212, draw actuator/cylinder 214, and roller 216. The clamp head 300 may be configured to engage the control line clamp 200, which, as shown, has two axial sections 220, 222. The scissor assembly 202 may include an extendable scissor linkage 230 (or another extensible structure) that is configured to position the clamp head 300 in proximity to a tubular string.

Figure 3A:
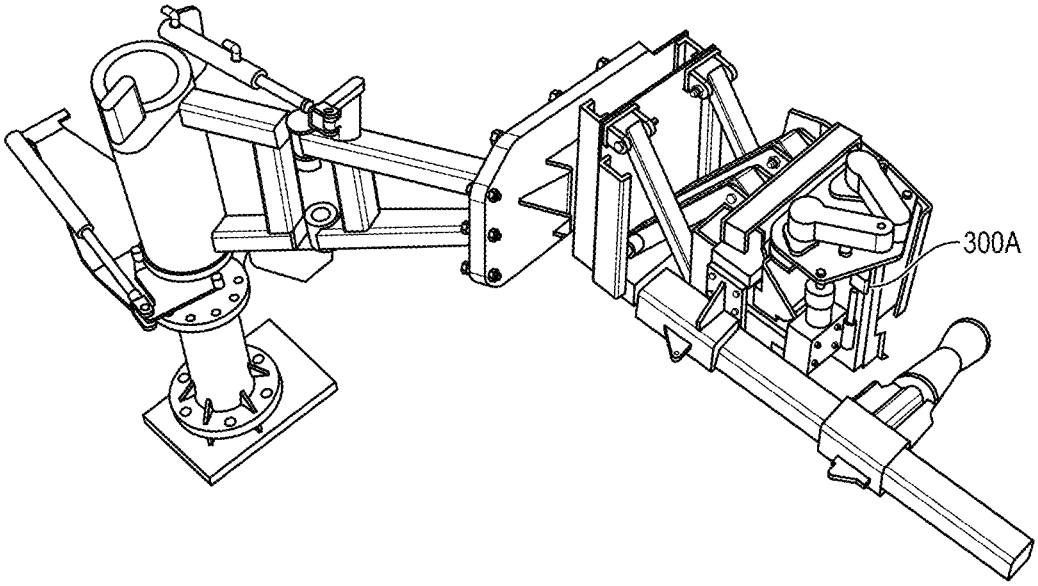
FIG. 3A illustrates a perspective view of the installation device with a first modular clamp head, according to an embodiment.
Figure 3B:
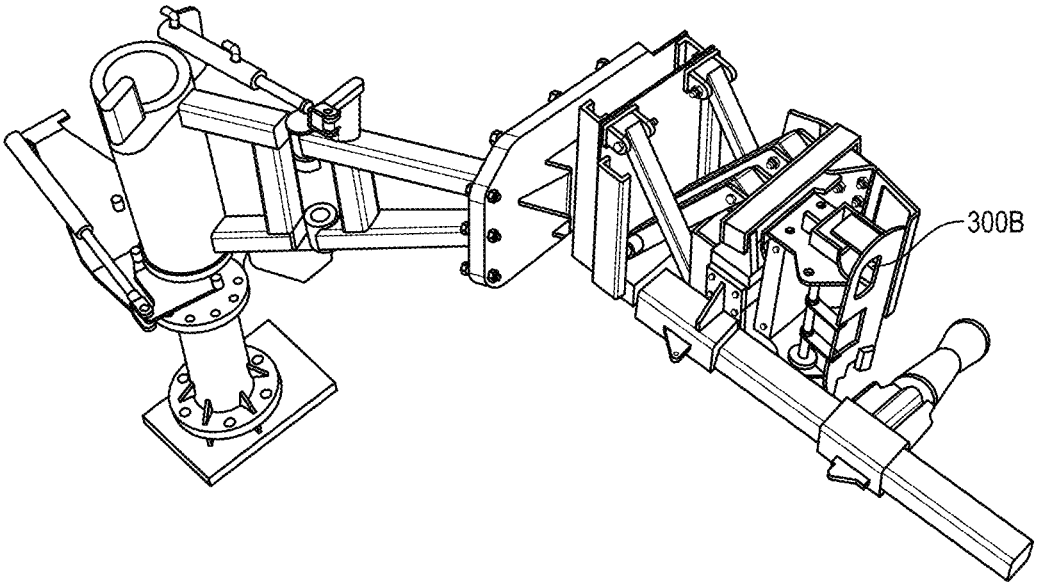
FIG. 3B illustrates a perspective view of the installation device with a second modular clamp head, according to an embodiment.

FIGS. 3A and 3B illustrate perspective views of the device 100, according to an embodiment, configured with two different clamp heads 300A, 300B. FIGS. 3A and 3B thus illustrate the modular features of the clamp heads 300A, 300B, allowing for a single device 100 to be used for multiple different types of axially-retained control line clamps. For example, the device 100 of FIG. 3A may be configured to install a bolt-together control line clamp, and the device 100 of FIG. 3B may be configured to install a radially forced clamp.

Figure 3C:
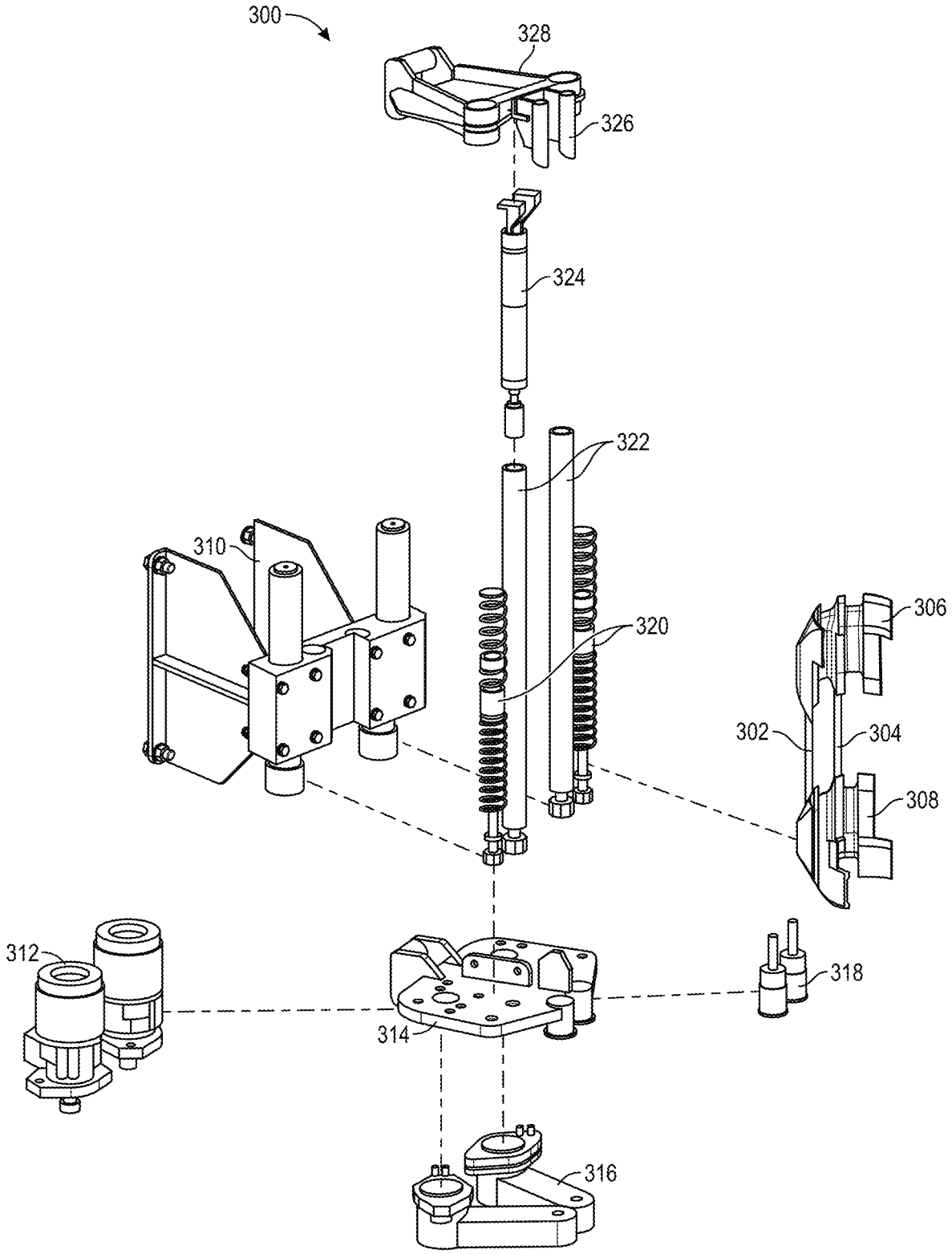
FIG. 3C illustrates an exploded view of a clamp head along with a clamp, according to an embodiment.
Figure 3D:
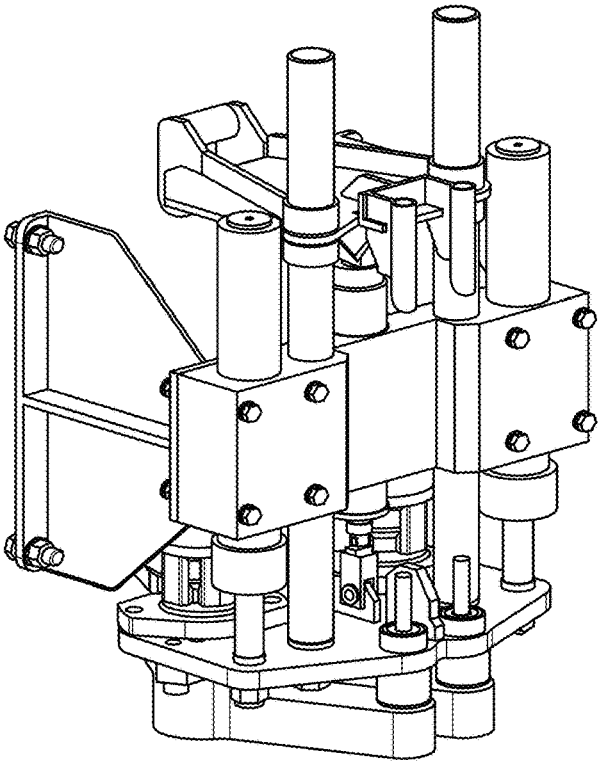
FIG. 3D illustrates a perspective view of the clamp head of FIG. 3C, according to an embodiment.
Figure 3E:
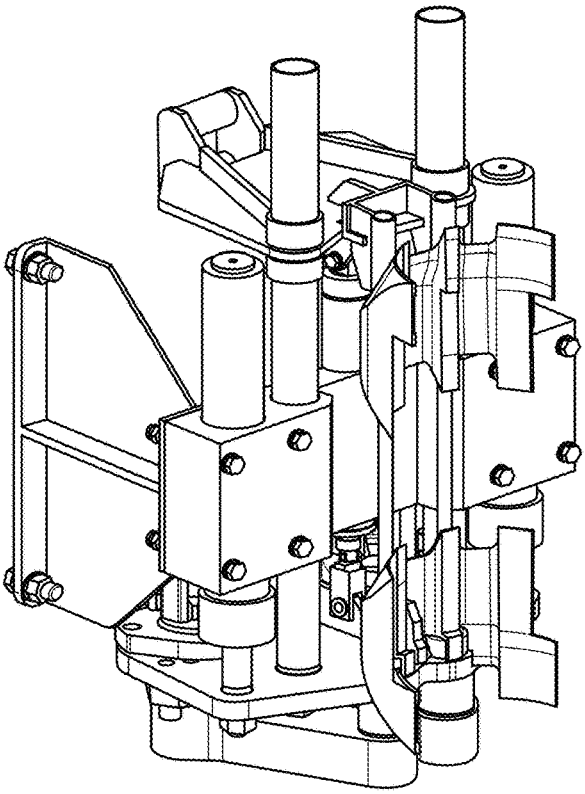
FIG. 3E illustrates a perspective view of the clamp head of FIGS. 3C and 3D, with a clamp positioned therein, according to an embodiment.

FIG. 3C illustrates an exploded view of an embodiment of a clamp head 300 (e.g., the clamp head 300A). This embodiment of the clamp head 300 may be configured to engage and turn bolts 302 that extend axially through a clamp 304, e.g., between two axial sections 306, 308 thereof. The clamp head 300 may include a bolted frame with plunger housings 310, a torqueing device 312, a torque base plate 314, offset heads 316, a spring-loaded hex head assembly 318, plungers 320, guide rods 322, a separation actuator/cylinder 324, and hollow fingers 326 configured as part of a guide plate 328. FIG. 3D illustrates the clamp head 300 assembled, without the clamp 304 positioned therein, and FIG. 3E illustrates the clamp head 300 assembled, with the clamp 304, according to an embodiment.

Figure 3F:
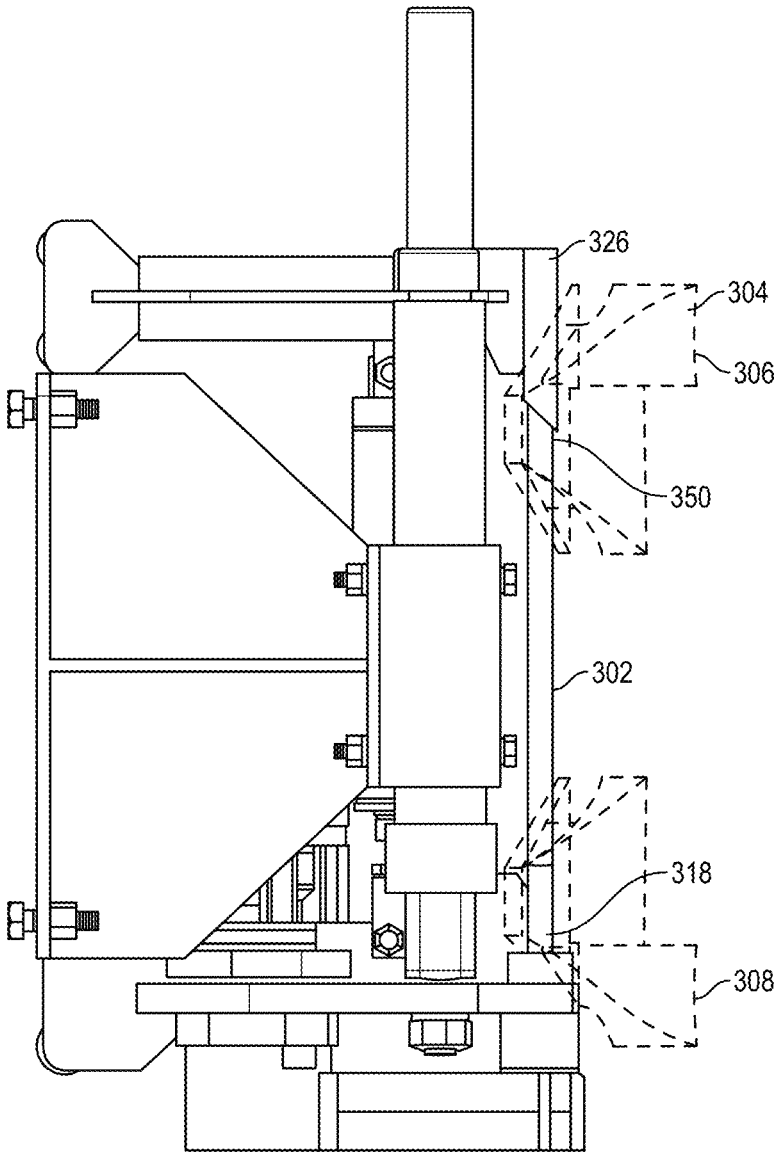
FIG. 3F illustrates a side view of the clamp head of FIGS. 3C-3E, showing the engagement between the clamp head and the clamp, according to an embodiment.

FIG. 3F shows the hex head assembly 318 engaging the bolts 302 of the clamp 304, e.g., in the lower axial section 308. On the other axial side, the fingers 326 engage the clamp section 306. A nut 350 or another threaded structure may be positioned within the clamp 304, such that turning the bolt 302 adducts the sections 306, 308 together.

Figure 4:
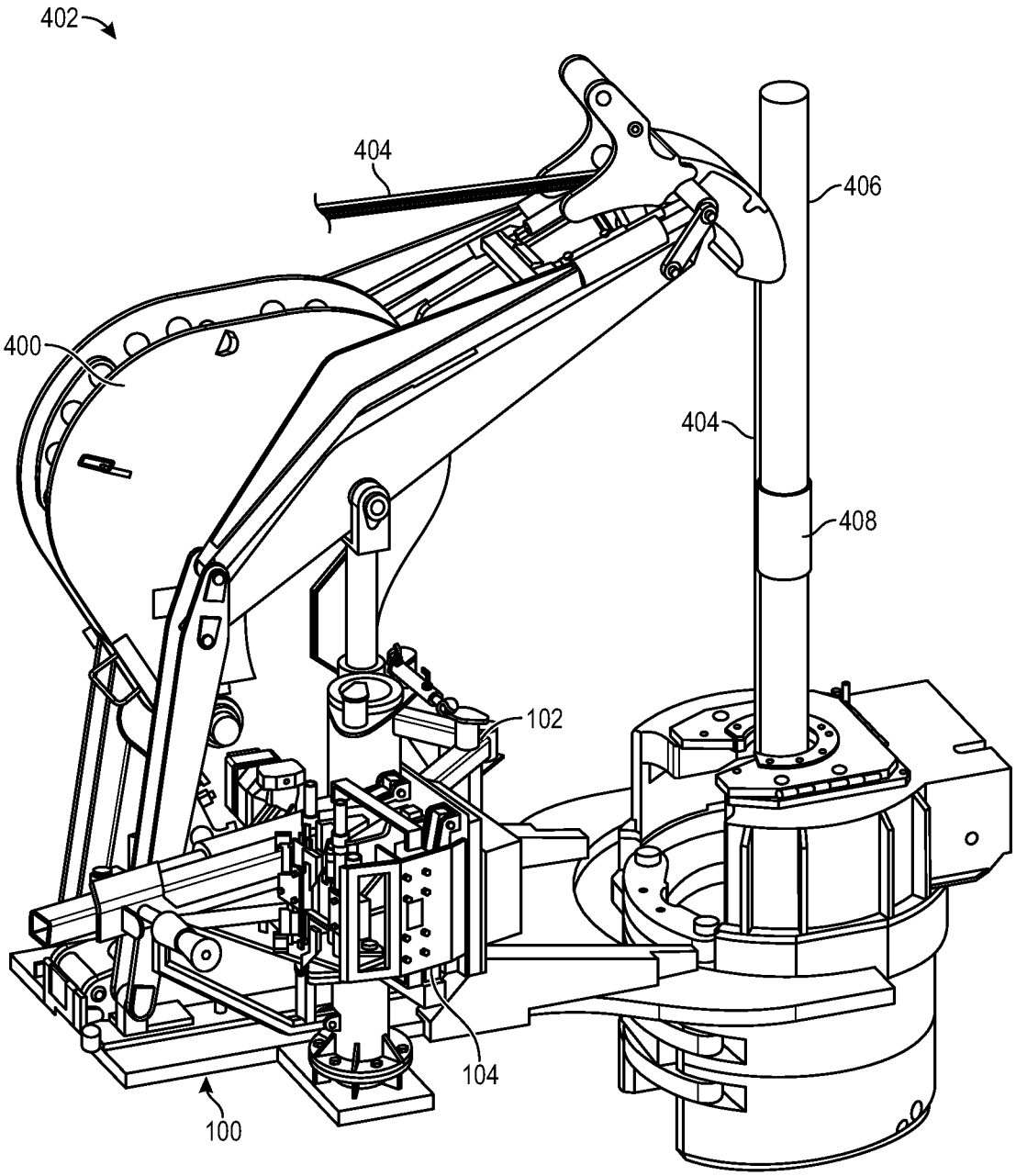
FIG. 4 illustrates a perspective view of the installation device and a control line manipulator arm, with the installation device being in a parked position, according to an embodiment.

FIG. 4 illustrates the device 100 secured to the base of a control line manipulating arm 400 and the rig floor 402, according to an embodiment. The manipulating arm 400 may be configured to deploy a control line 404 along a tubular string 406. Further, the clamps discussed herein may be secured by engagement with a coupling 408 of the tubular string 406.

Referring now to the operation of the device 100, with continuing reference to FIG. 4, there is shown a first stage of operation, according to an embodiment. As shown, the manipulator arm assembly 102 of the device 100 may be in a "parked" or "loading" position, e.g., with the clamp installation assembly 104 rotated away from and, e.g., facing away from the tubular string 406. In this stage, the tubular string 406 may be run into the wellbore, with the control line manipulating arm 400 deploying the control line 404 along the tubular string 406. The coupling 408 connects to adjacent tubulars of the tubular string 406 together, and the control line 404 runs along and past the coupling 408.

Figure 5:
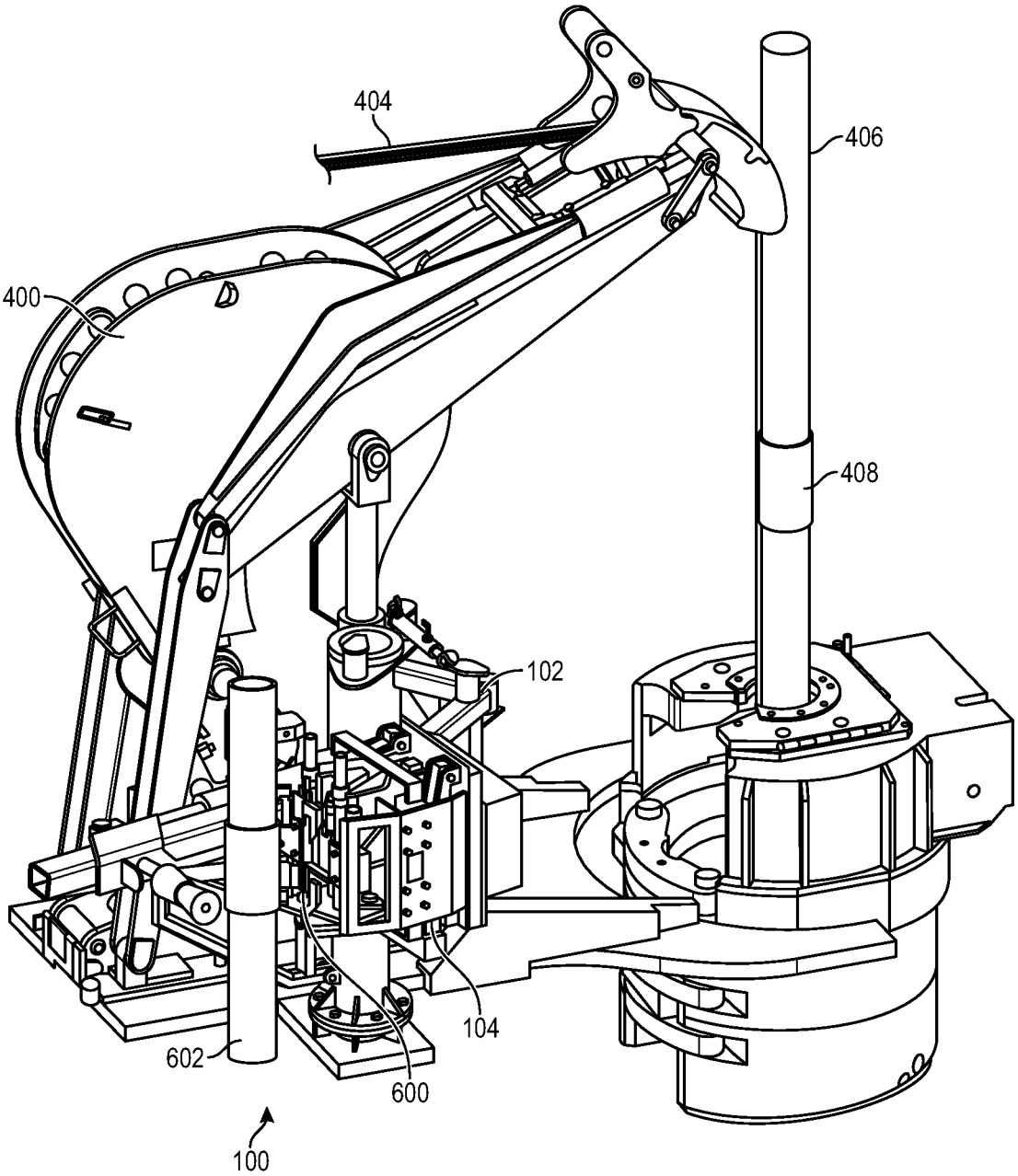
FIG. 5 illustrates a perspective view of the installation device and the control line manipulator arm receiving a clamp, according to an embodiment.
Figure 6:
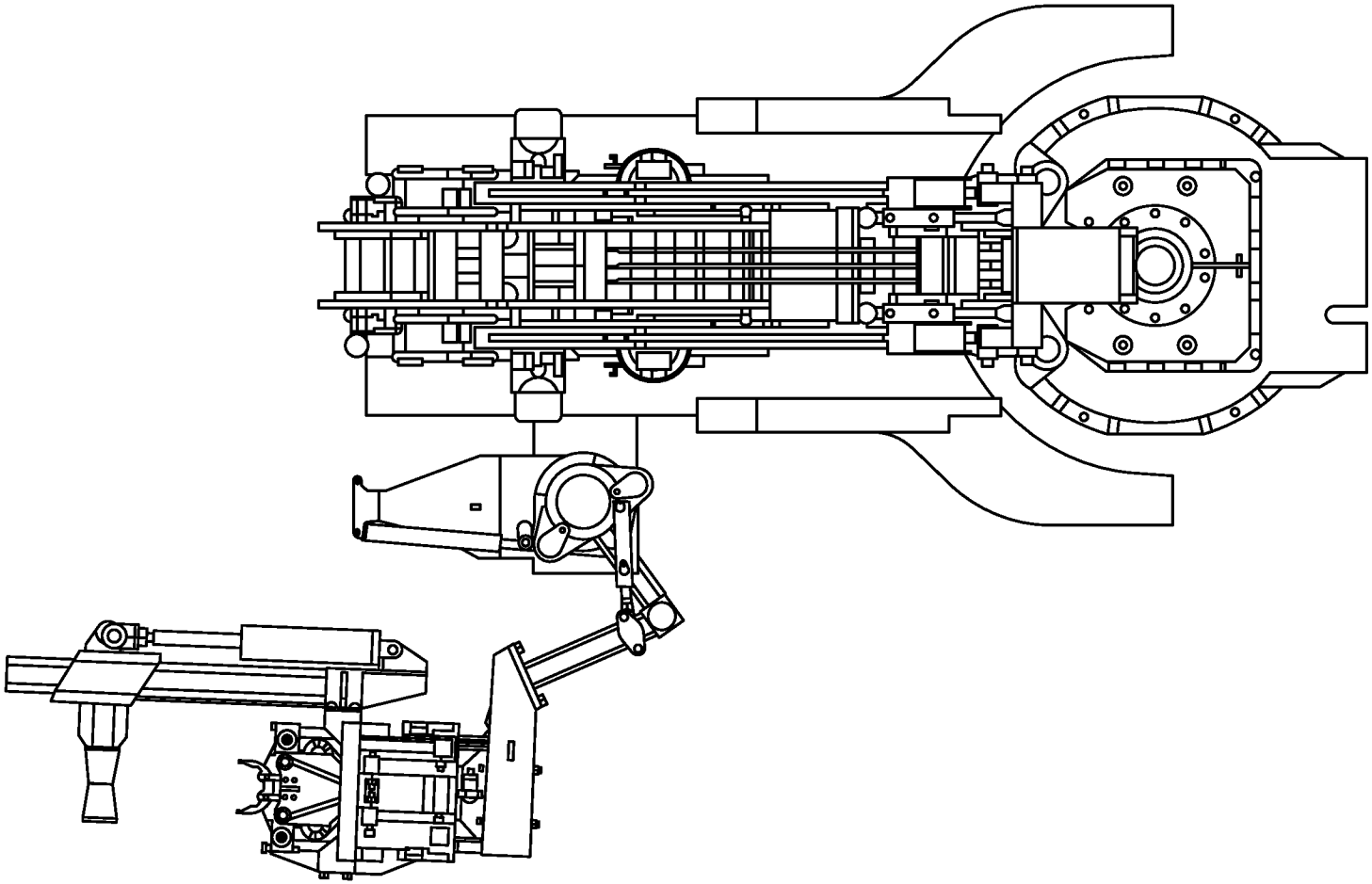
FIG. 6 illustrates the same configuration as FIG. 5 (except the loading mandrel is not shown in FIG. 6), but in top, plan view, according to an embodiment.

Next, as shown in FIG. 5, a clamp 600 may be loaded into and received by the clamp installation assembly 104, particularly the clamp head 300 (e.g., FIGS. 3A-3F). FIG. 6 illustrates a top view of this stage. Referring to FIGS. 5 and 6, the clamp 600 is first temporarily held by a loading mandrel 602, which is brought into proximity of the clamp installation assembly 104. In other embodiments, the clamp 600 may be manually loaded into the clamp installation assembly 104 by a rig worker. In still other embodiments, a magazine of clamps may be positioned proximal to the clamp installation assembly 104, such that multiple clamps are fed, in sequence, to the clamp installation assembly 104 on demand.

Figure 7A:
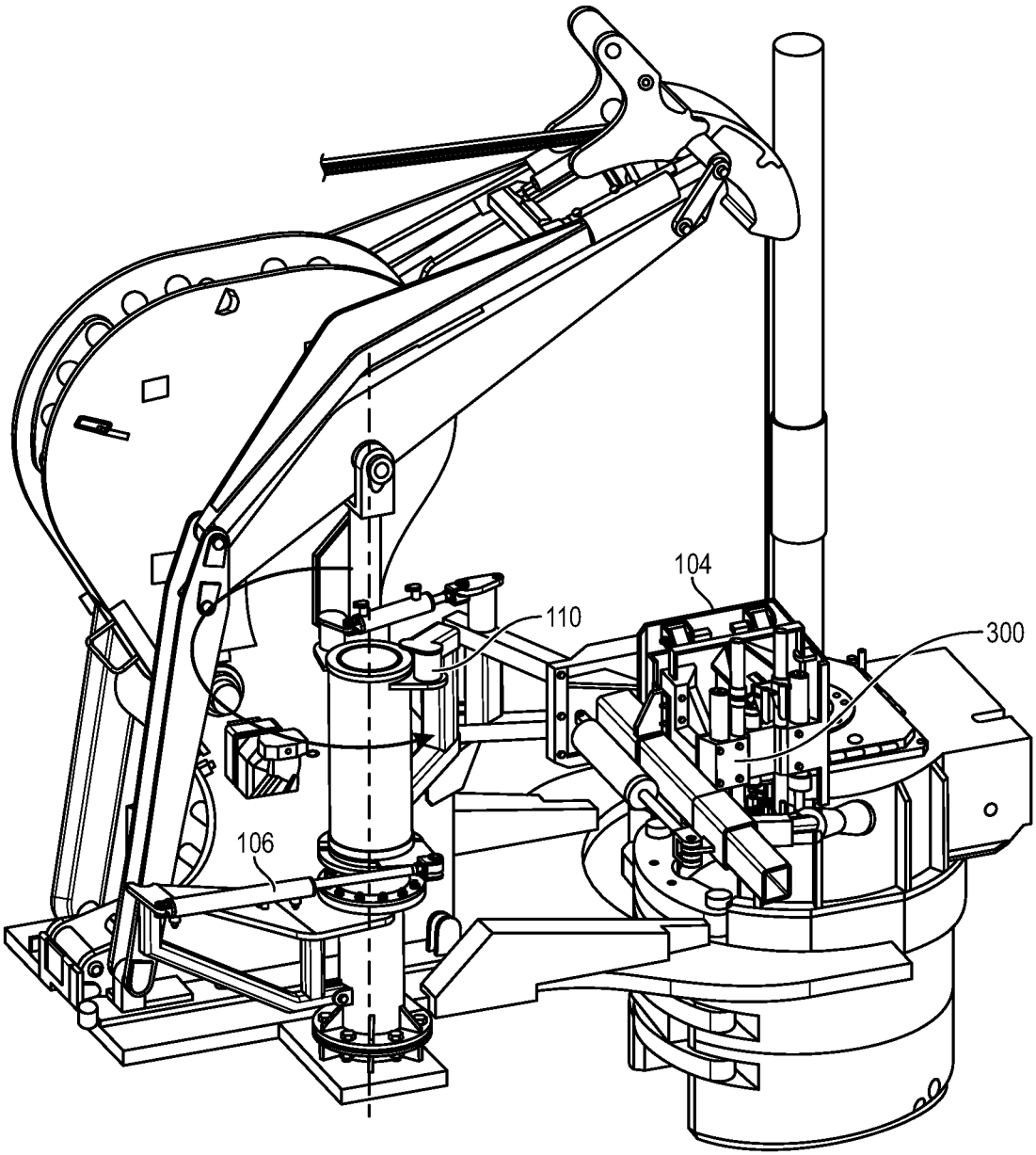
FIGS. 7A and 7B illustrate a perspective view and a top view, respectively, of the installation device and the control line manipulator arm, with the installation device in an intermediate position, according to an embodiment.
Figure 7B:
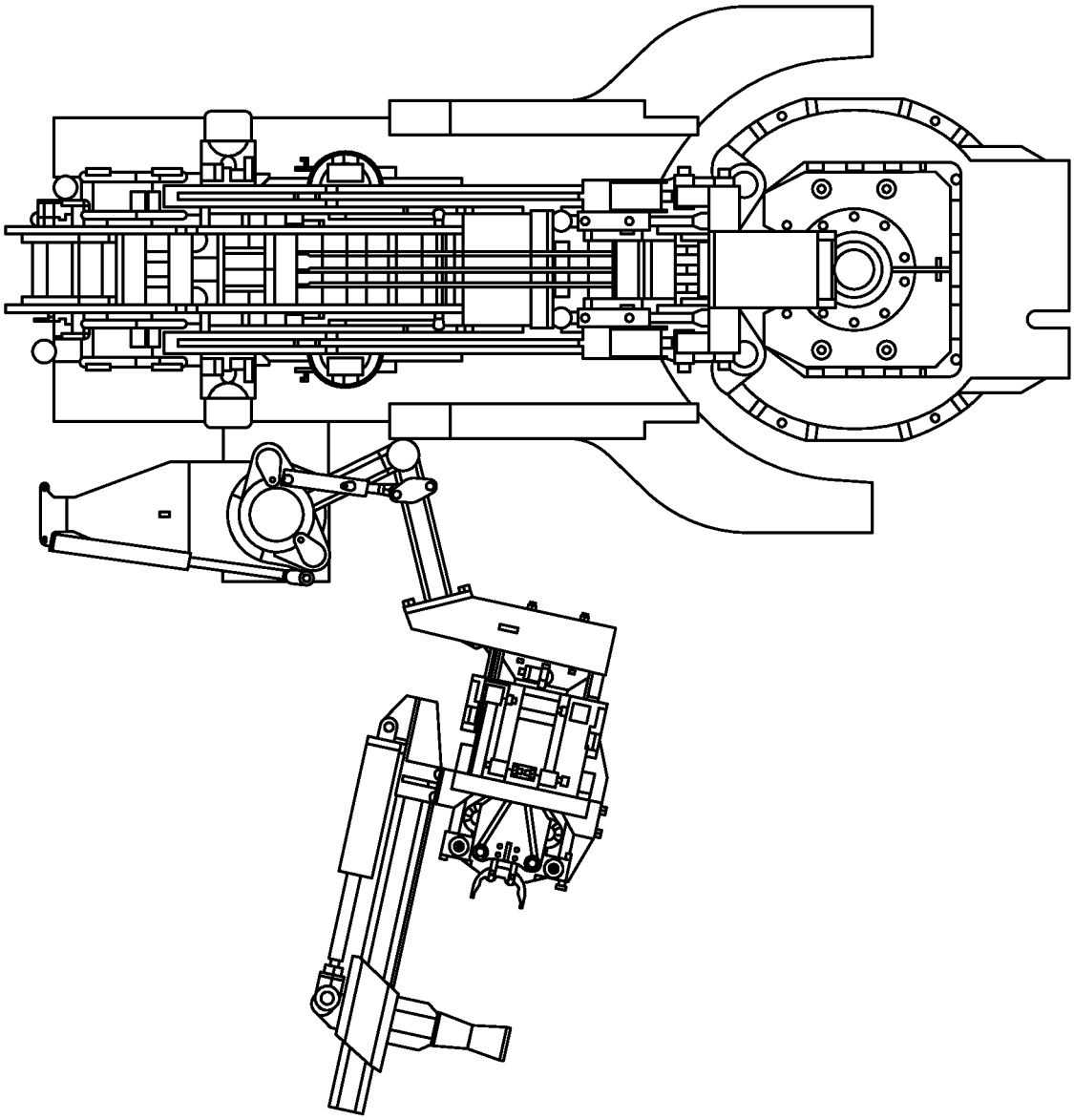

As shown in FIG. 7A, the actuator 106 may extend, and pivot the arm 110 about a first pivot axis ("Axis 1"), which brings the clamp installation assembly 104 from the first (e.g., parked) position to a second (e.g., intermediate) position. FIG. 7B illustrates the intermediate position in top, plan view.

Figure 8A:
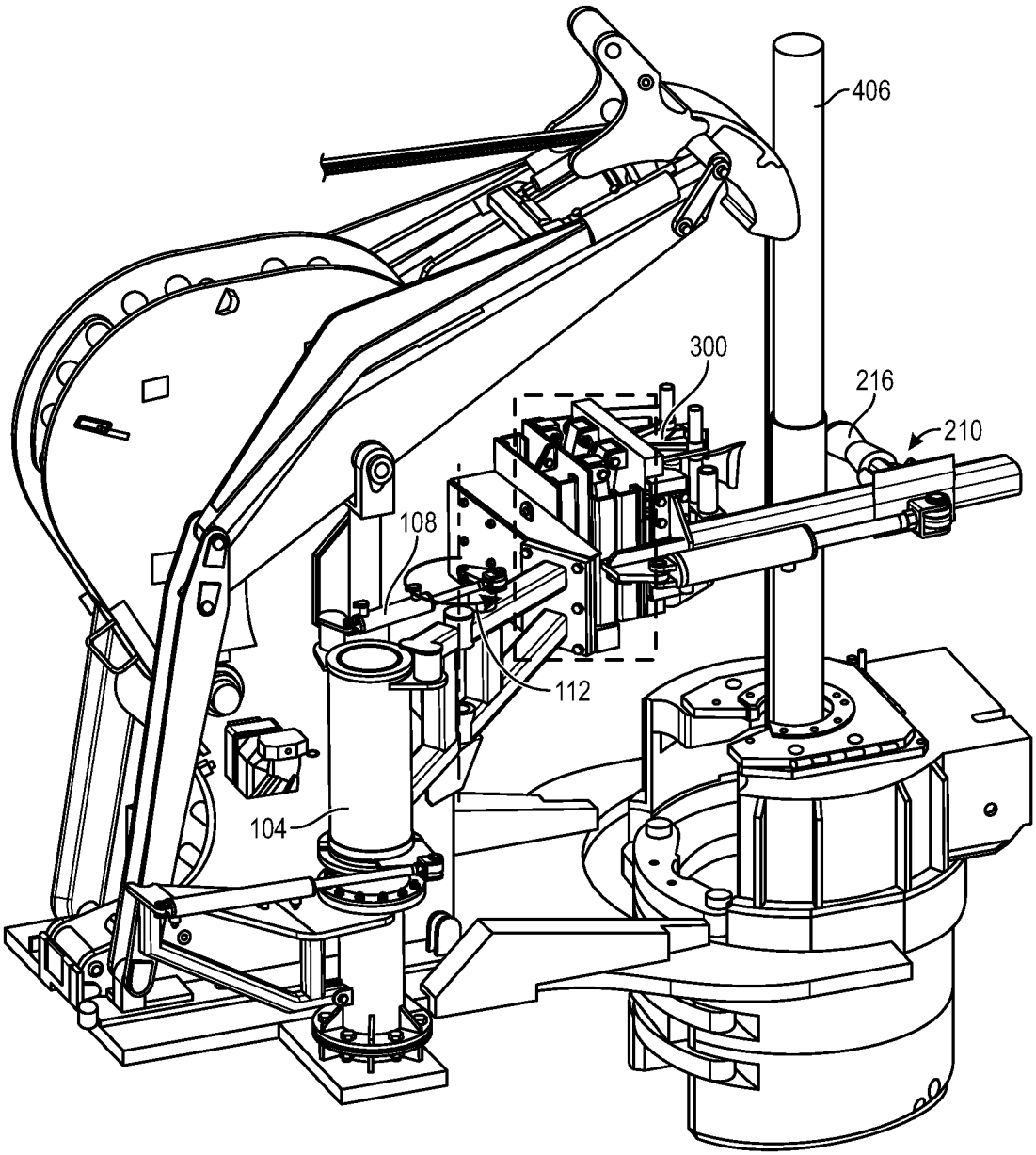
FIGS. 8A and 8B illustrate a perspective view and a top view, respectively, of the installation device and the control line manipulator arm with the clamp installation assembly at well center, according to an embodiment.
Figure 8B:
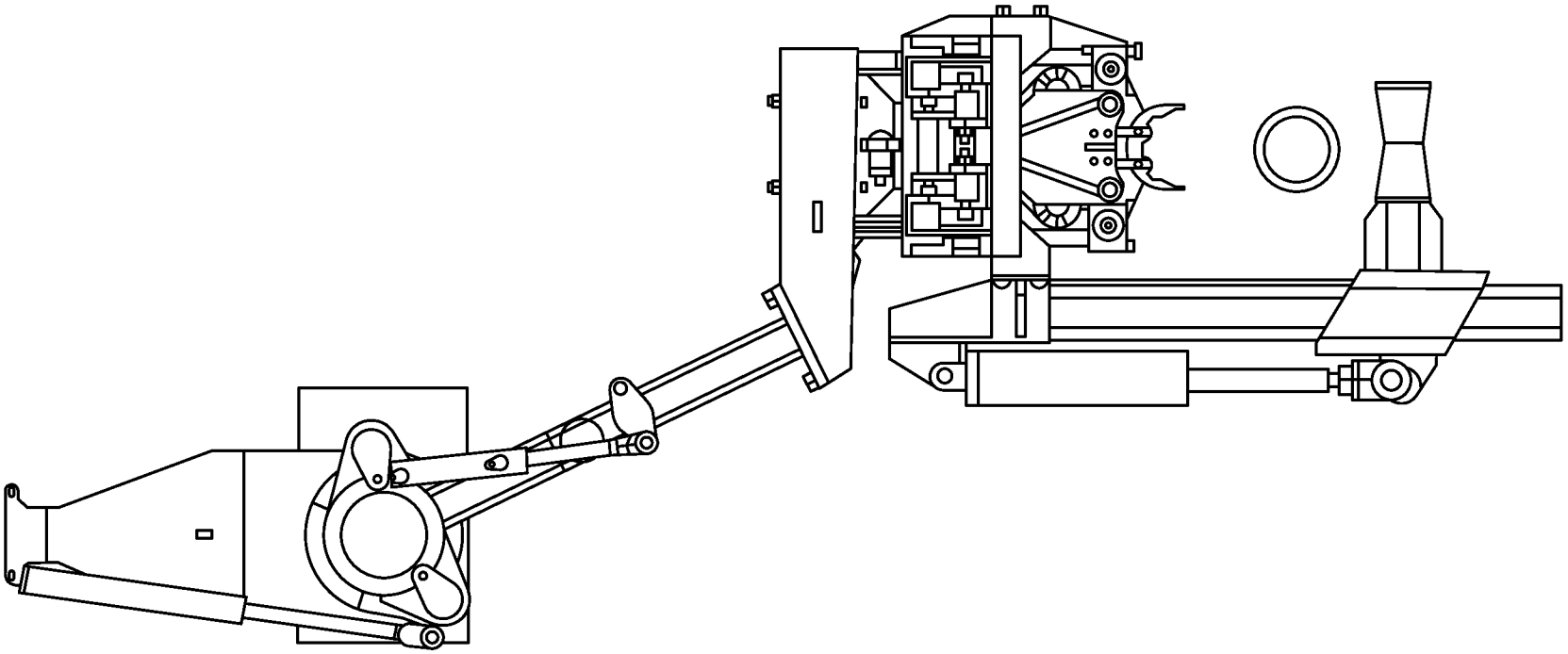

Advancing to FIG. 8A, the other actuator 108 may extend and pivot the arm 112 about a second pivot axis ("Axis 2"), which brings the clamp installation assembly 104 to an installation position, proximal to well center. In this position, the tubular string 406 may be received between the roller 216 of the draw mechanism 210 and the clamp head 300. FIG. 8B shows this same position in top, plan view.

Figure 9A:
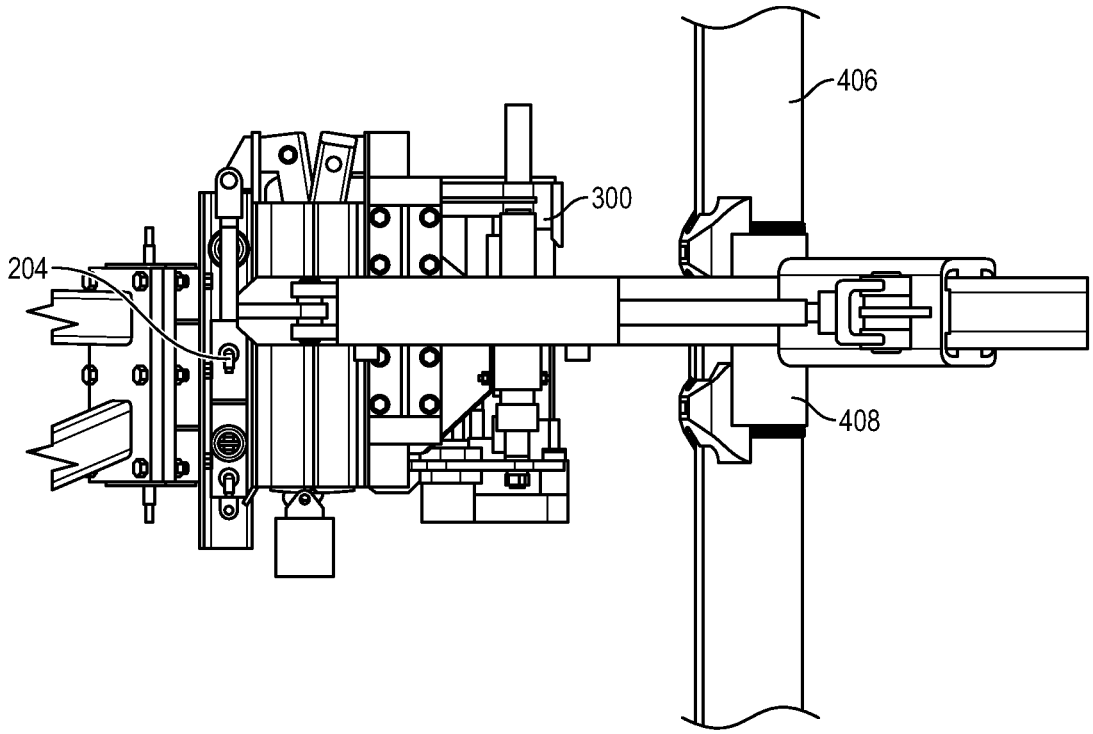
FIGS. 9A and 9B illustrate side views of the clamp installation assembly in a vertically raised position and a vertically lowered position, respectively, according to an embodiment.
Figure 9B:
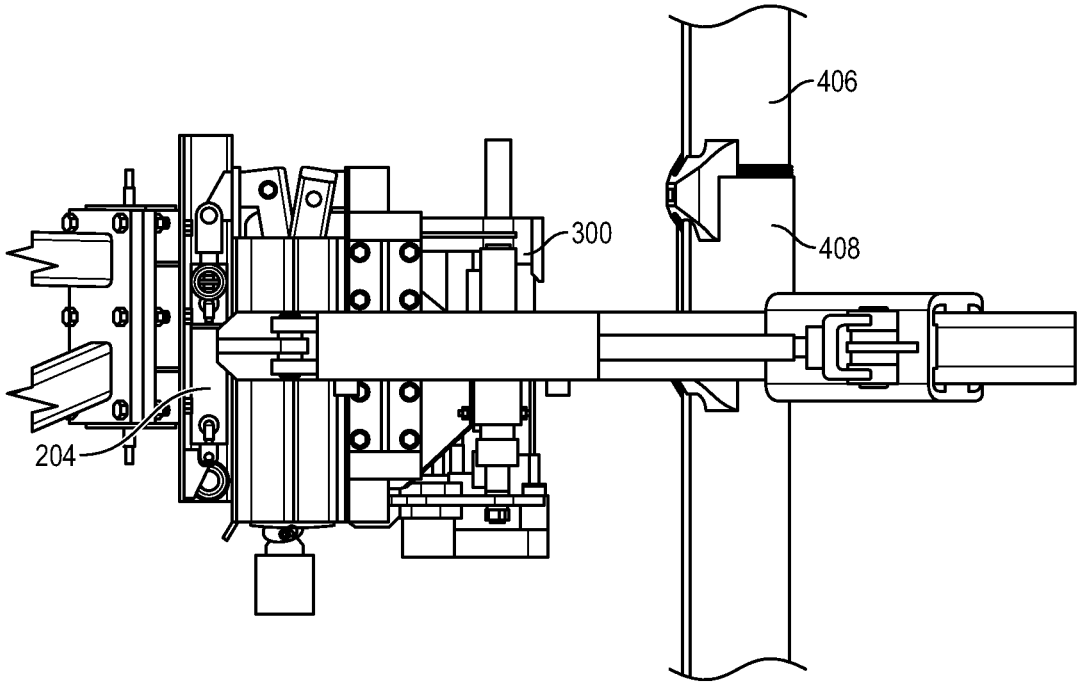

Next, as shown in FIGS. 9A and 9B, the vertical adjustment actuator 204 may extend or retract, thereby moving the clamp head 300 up or down along the tubular string 406. This may allow the clamp head 300 to be generally vertically centered on the coupling 408. FIG. 9A shows the vertical adjustment actuator 204 in a fully extended position, while FIG. 9B shows the vertical adjustment actuator 204 in a fully retracted position.

Figure 10:
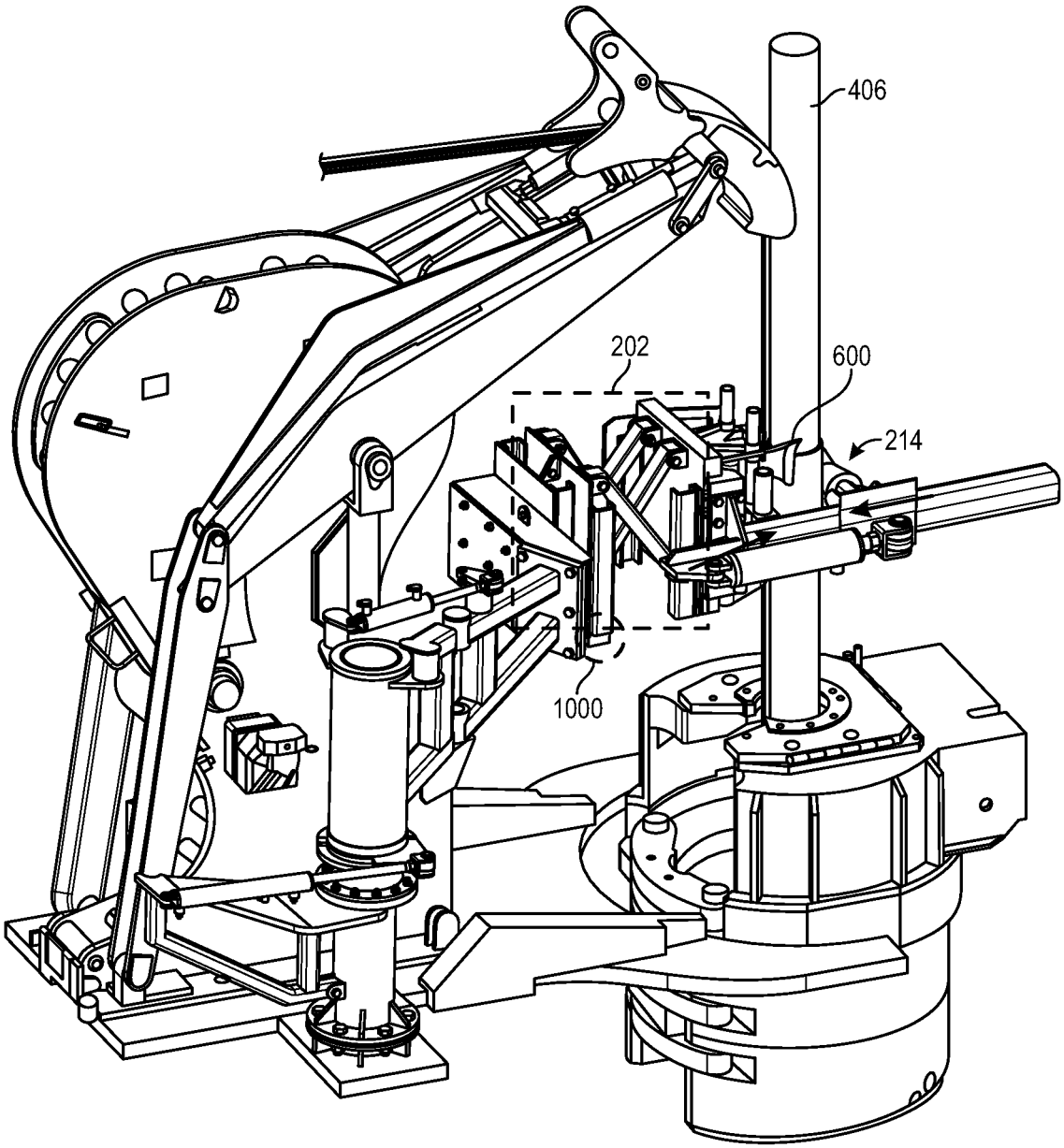
FIG. 10 illustrates a perspective view of the installation device and the control line manipulator arm, with the clamp installation assembly of the installation device pressing a clamp into engagement with a tubular string, according to an embodiment.

Proceeding to FIG. 10, the draw actuator 214 may then be retracted. The draw actuator 214 is connected to the scissor assembly 202, such that the draw actuator 214 engaging and pressing against the tubular string 406 causes the scissor assembly 202 to extend. As the scissor assembly 202 extends, the clamp 600 is pressed into engagement with the coupling 408 and is ready to be secured thereto. In some embodiments, the scissor assembly 202 is biased toward retracted, e.g., by provision of a counterweight 1000. In other embodiments, springs or any other type of device or structure configured to provide a biasing force may be employed to retract the scissor assembly 202 away from the tubular string 406.

Figure 11:
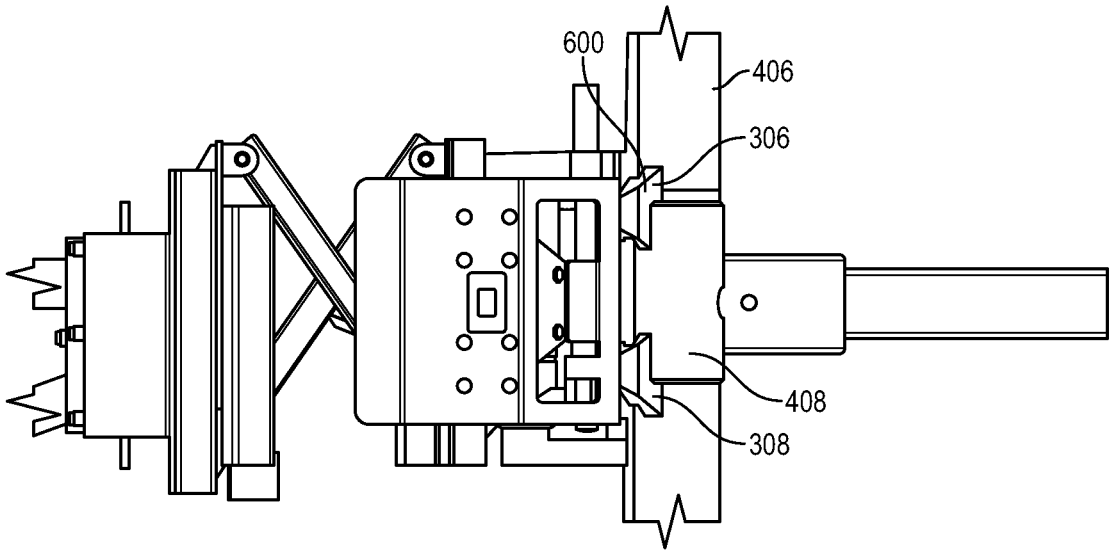
FIGS. 11 and 12 illustrate side views of the clamp installation device installing the clamp on the tubular, according to an embodiment.
Figure 12:
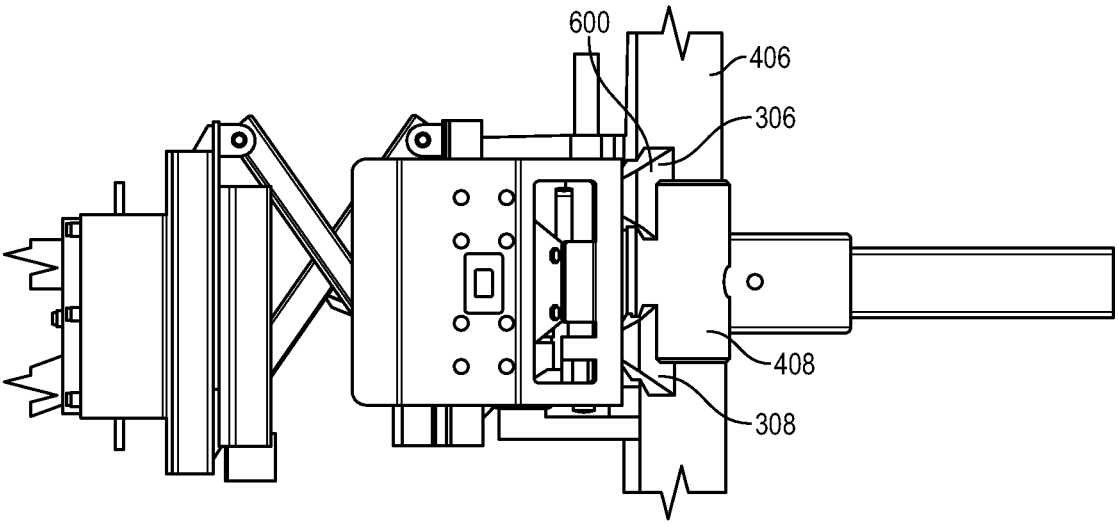

FIG. 11 shows the clamp installation assembly 104 in position with the clamp 600 positioned on the coupling 408, but without the bolts 302 (FIG. 3E) tightened. There may be a radial gap between the coupling 408 and the tubular string 406. The clamp 600 may include a shoulder, lip, hook, or another structure ("shoulder feature") configured to fit snugly into this gap as the bolts 302 are tightened. FIG. 12 shows the same view as FIG. 11, but after the bolts 302 have been tightened to adduct the sections 306, 308 and thereby secure the clamp 600 onto the coupling 408.

Figure 13:
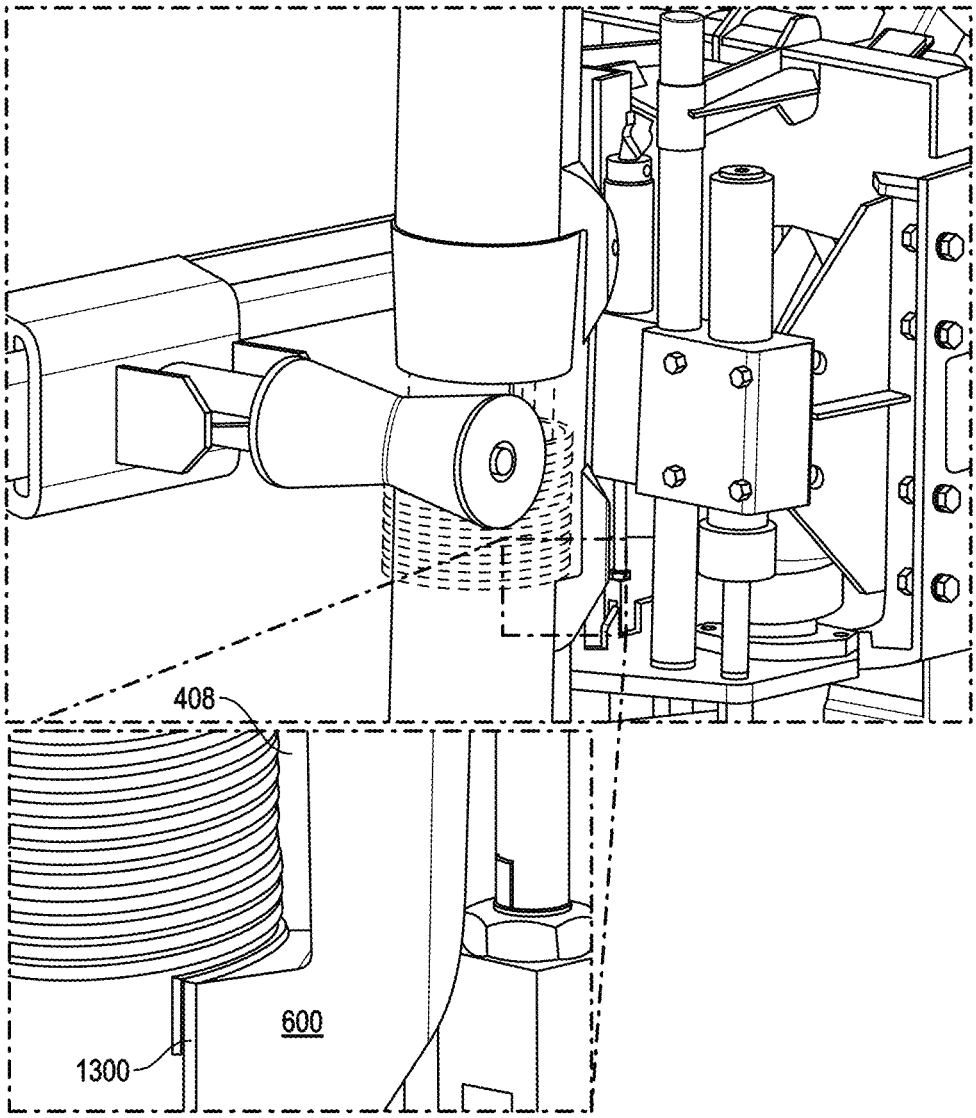
FIG. 13 illustrates an enlarged view of the clamp, coupling, and tubular string, showing a shoulder feature of the clamp fitting between the coupling and the tubular string, according to an embodiment.
Figure 14:
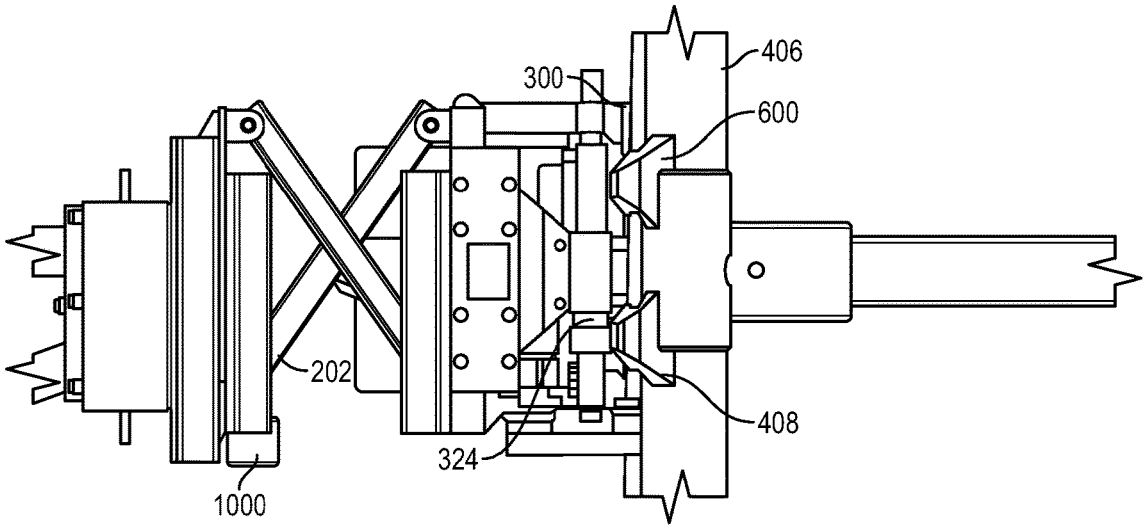
FIGS. 14, 15, and 16 illustrate side views of the clamp head of the clamp installation device disengaging from the clamp and retracting, according to an embodiment.
Figure 15:
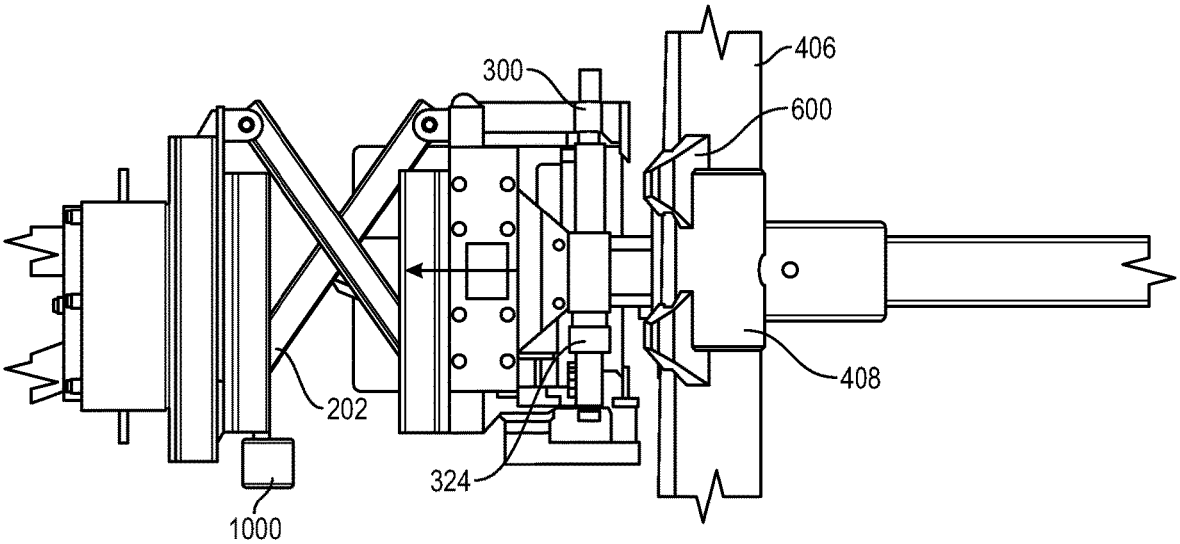
Figure 16:
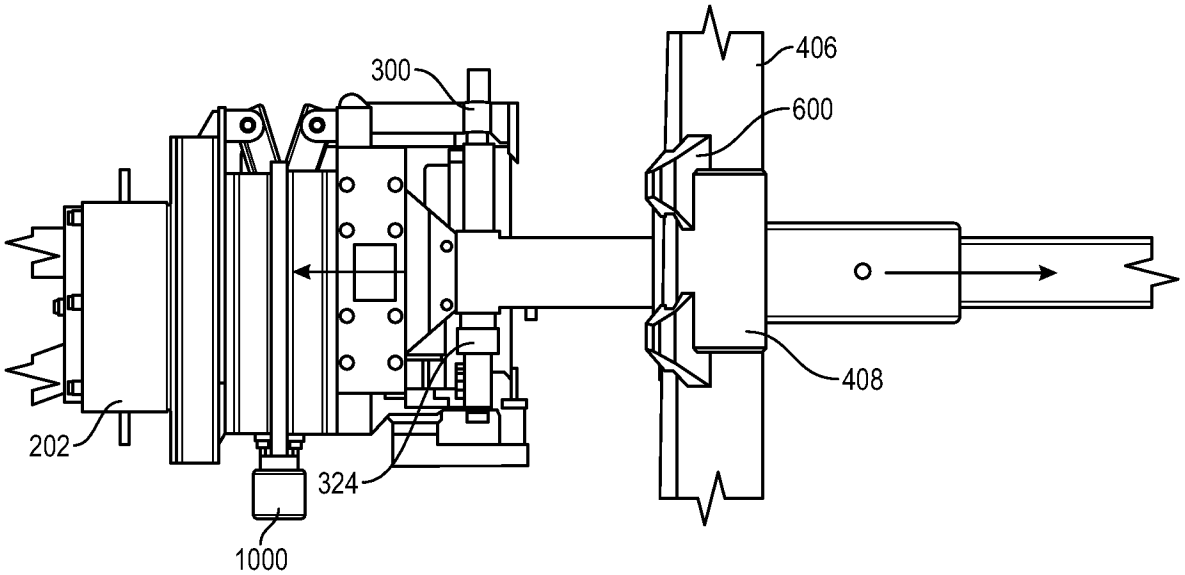
Figure 17:
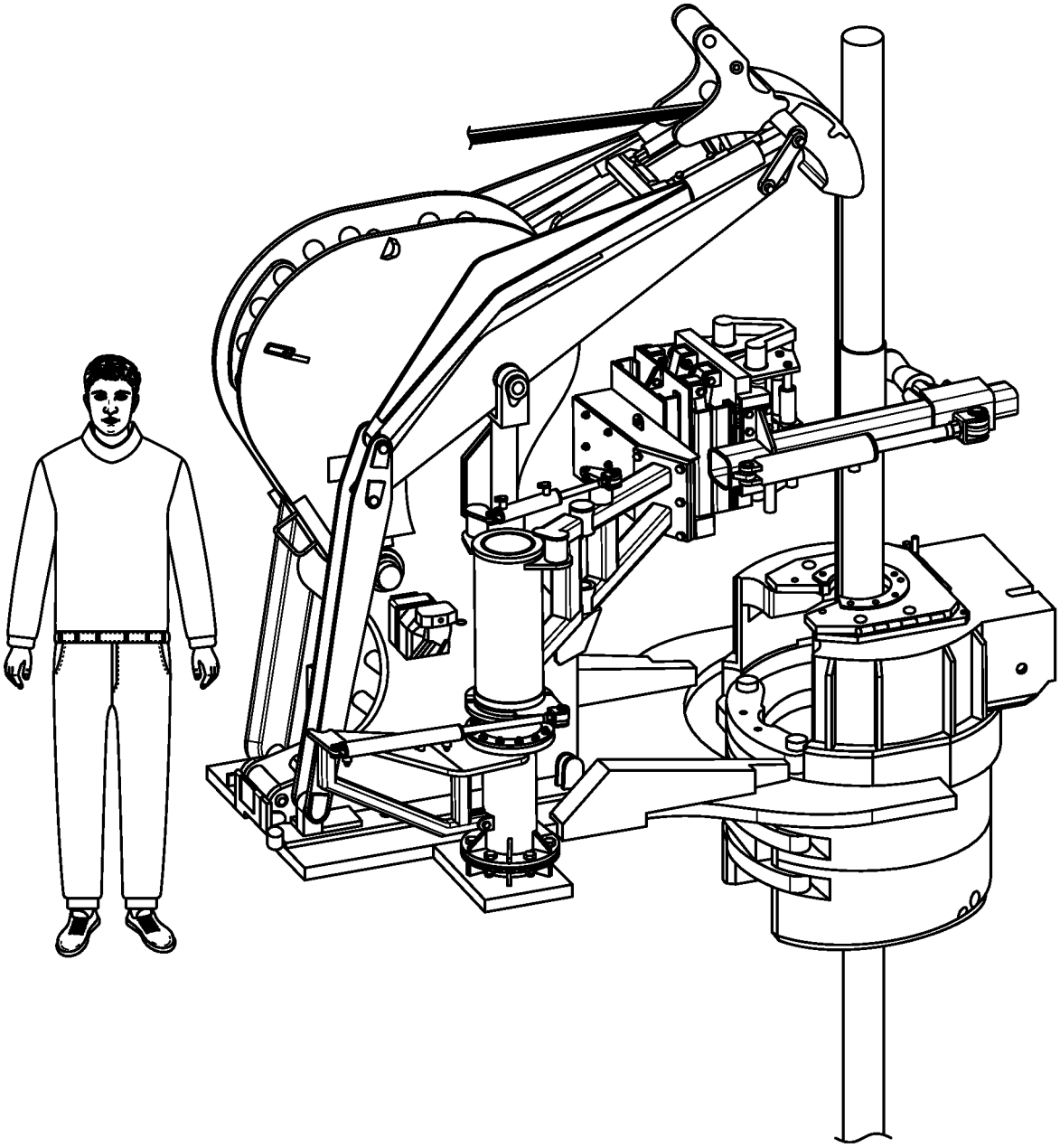
FIG. 17 illustrates a perspective view of the installation device and the control line manipulator arm with the installation device retracted from the tubular string, according to an embodiment.

FIG. 13 shows an enlarged view of the shoulder feature of the clamp 600. The coupling 408 is depicted as translucent to show the shoulder feature 1300 of the clamp 600 received between the tubular string 406 and the coupling 408.

With the clamp 600 now secured to the coupling 408, as shown in FIGS. 14-17, the clamp installation assembly 104 may be moved away from the tubular string 406, e.g., to connect to another clamp. As such, the separation cylinder 324 may be actuated to extend and separate the clamp head 300 away from the clamp 600. Next, the draw cylinder 214 (e.g., FIG. 2) may extend, and the counterweight 1000 may draw the scissor assembly 202 to retract, thereby pulling the clamp head 300 away from the tubular string 406.

Next, the actuators 106, 108 may retract, thereby rotating the manipulator arm assembly 102, such that the clamp installation assembly 104 is away from the tubular string 406 and back in the loading position, and the process may repeat for the next clamp/coupling on the tubular string 406.

Figure 18:
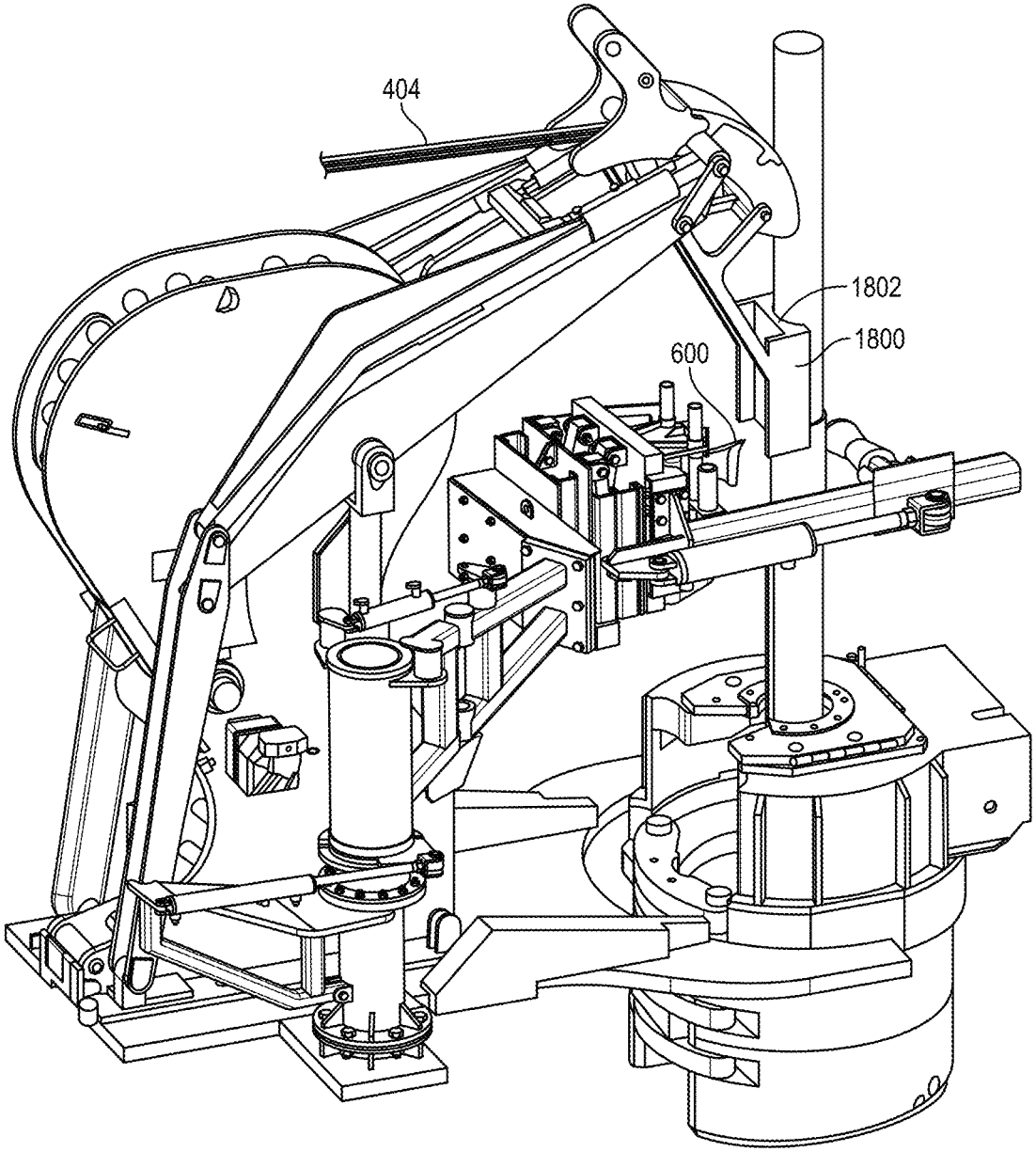
FIG. 18 illustrates a perspective view of the installation device and the control line manipulator arm, depicting a control line positioner of the control line manipulator arm, according to an embodiment.

As shown in FIG. 18, in at least one embodiment, the control line manipulator arm 400 may include a control line positioner 1800, which may include a channel 1802 through which the control line 404 is received. The channel 1802 may be circumferentially aligned with notches formed in the clamp 600. As such, the control line positioner 1800 may thus ensure a reliable positioning of the control line 404 in a circumferential direction, such that the control lines fit into the proper position within the clamp so that the clamp installation does not damage the control lines 404.

Figure 19:
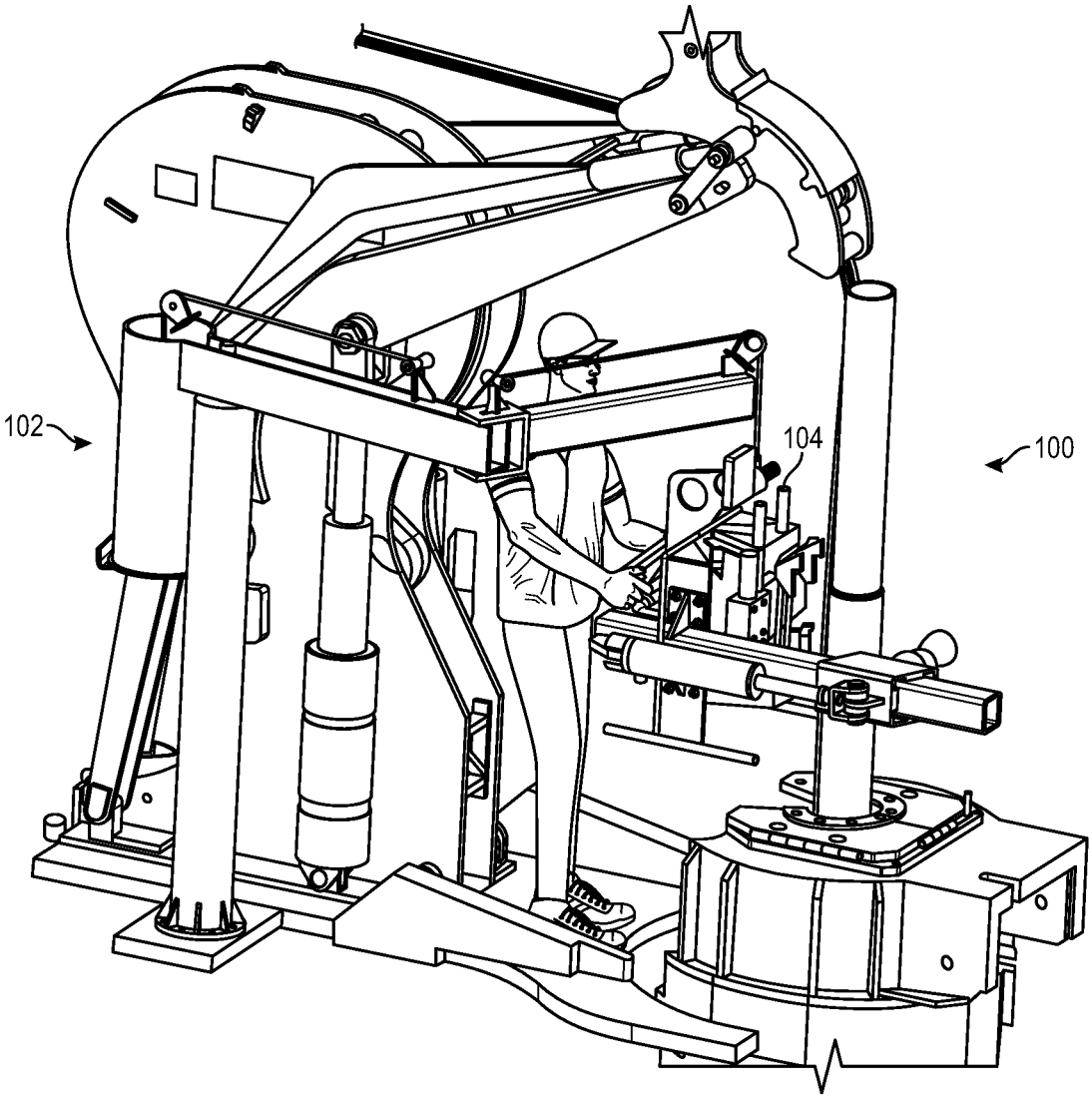
FIG. 19 illustrates a perspective view of another installation device and the control line manipulator arm, according to an embodiment.

In another embodiment, as shown in FIG. 19, a human operator may at least partially control the device 100 at or near to well center. In such case, for example, the manipulator arm assembly 102 may include a hoist, as shown, and one or more pivotable arms. In other cases, the device may be suspended from an overhead cable without being connected to a base or anchor at the rig floor. A user may operate a control panel on the clamp installation assembly 104, which may control the process discussed above, enabling the user to move the clamp installation assembly 104 toward and away from well center, engage the tubular string, actuate the various cylinders to position the clamp, and torque the bolts.

Figure 20:
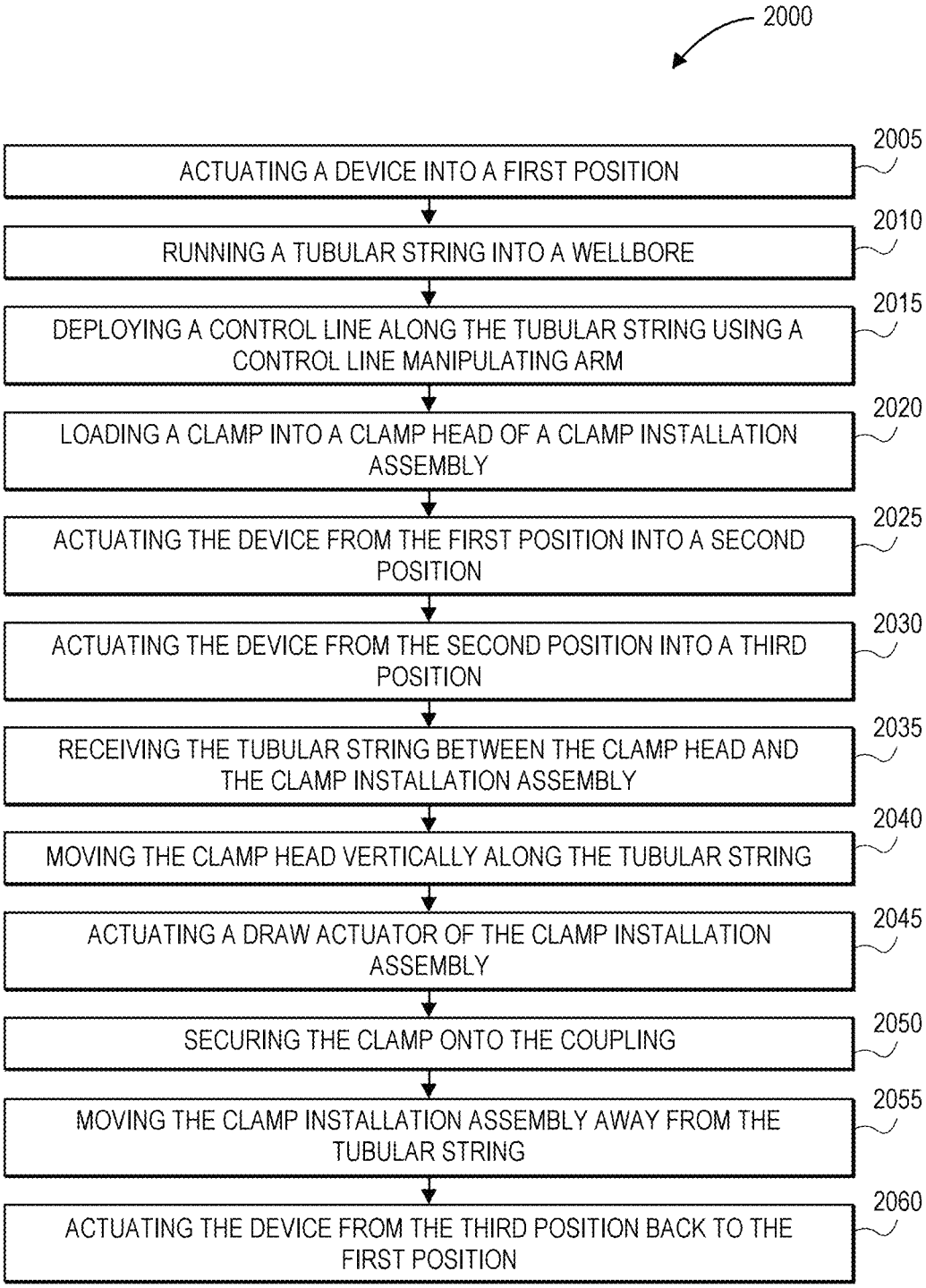
FIG. 20 illustrates a flowchart of a method for installing the clamp, according to an embodiment.

FIG. 20 illustrates a flowchart of a method 2000 for installing the clamp 600, according to an embodiment. An illustrative order of the method 2000 is provided below; however, one or more steps of the method 2000 may be performed in a different order, simultaneously, repeated, or omitted.

The method 2000 may include actuating the device 100 into a first position, as at 2005. The clamp installation assembly 104 of the device 100 may face away from the tubular string 406 when the device 100 is in the first position.

The method 2000 may also include running the tubular string 406 into a wellbore, as at 2010. The tubular string 406 may be run while the device 100 is in the first position.

The method 2000 may also include deploying the control line 404 along the tubular string 406 using the control line manipulating arm 400, as at 2015. The coupling 408 connects adjacent tubulars of the tubular string 406 together. The control line 404 runs along and past the coupling 408. In an embodiment, the device 100 may be secured to a base of the control line manipulating arm 400. As mentioned above, the control line manipulator arm 400 may include the control line positioner 1800 which defines the channel 1802 through which the control line 404 may be received. The channel 1802 may be circumferentially aligned with notches formed in the clamp 600 to position of the control line 404 in a circumferential direction.

The method 2000 may also include loading the clamp 600 into the clamp head 300 of the clamp installation assembly 104, as at 2020.

The method 2000 may also include actuating the device 100 from the first position into a second position, as at 2025. The device 100 may be actuated by extending the first actuator 106 of the device 100. The first arm 110 of the device 100 pivots about a first pivot axis (Axis 1) in response to extending the first actuator 106. The clamp installation assembly 104 moves in response to pivoting the first arm 110 about the first pivot axis.

The method 2000 may also include actuating the device 100 from the second position into a third position, as at 2030. The device 100 may be actuated by extending the second actuator 108 of the device 100. The second arm 112 of the device 100 pivots about a second pivot axis (Axis 2) in response to extending the second actuator 108. The clamp installation assembly 104 moves toward the well center in response to pivoting the second arm 112 about the second pivot axis.

The method 2000 may also include receiving the tubular string 406 between the clamp head 300 and the roller 216 of the draw mechanism 210 of the clamp installation assembly 104, as at 2035. The tubular string 406 may be received when the device 100 is in the third position.

The method 2000 may also include moving the clamp head 300 vertically along the tubular string 406, as at 2040. The clamp head 300 may be moved to at least partially align the clamp head 300 with the coupling 408. The clamp head 300 may move in response to actuating the vertical adjustment actuator 204 of the clamp installation assembly 104.

The method 2000 may also include actuating the draw actuator 214 of the clamp installation assembly 104, as at 2045. Actuating the draw actuator 214 may include retracting the draw actuator 214, which causes the draw actuator 214 to engage the tubular string 406. Actuating the draw actuator 214 may also or instead cause the scissor assembly 202 of the clamp installation assembly 104 to extend. The clamp 600 may be pressed into engagement with the coupling 408 in response to the scissor assembly 202 extending. The scissor assembly 202 biased toward retracting by the counterweight 1000.

The method 2000 may also include securing the clamp 600 onto the coupling 408, as at 2050. Securing the clamp 600 may include adducting two sections 306, 308 of the clamp head 300 together. The clamp 600 may be secured while the clamp 600 is pressed into engagement with the coupling 408. The clamp 600 may include a shoulder feature configured to be positioned in a radial gap between the coupling 408 and the tubular string 406.

The method 2000 may also include moving the clamp installation assembly 104 away from the tubular string 406, as at 2055. The clamp installation assembly 104 may be moved once the clamp 600 is secured to the coupling 408. Moving the clamp installation assembly 104 may include actuating the draw actuator 214. Actuating the draw actuator 214 may include extending the draw actuator 214, which then allows the counterweight 1000 to cause the scissor assembly 202 to retract. The clamp head 300 may move away from the tubular string 406 in response to the scissor assembly 202 retracting.

The method 2000 may also include actuating the device 100 from the third position back to the first position, as at 2060. The device 100 may be actuated by retracting the first and second actuators 106, 108. The clamp installation assembly 104 may move until it is facing away from the tubular string 406 in response to retracting the first and second actuators 106, 108.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A clamp installation system, comprising:

a clamp head configured to engage a top section and a bottom section of an axially-retained control line clamp; and a manipulator assembly configured to bring the clamp head close to and away from a tubular string run into a well, wherein the clamp head is configured to position the top and bottom sections of the axially-retained control line clamp on opposite axial sides of a coupling of the tubular string, and wherein the clamp head is configured to drive the top and bottom sections of the axially-retained control line clamp axially-together so as to secure the axially-retained control line clamp to the coupling.

2. The clamp installation system of claim 1, wherein the clamp head is a part of a clamp installation assembly coupled to the manipulator assembly, wherein the clamp installation assembly comprises a first actuator and a first arm, and wherein the first arm pivots around a first pivot axis in response to extending the first actuator.

3. The clamp installation system of claim 2, wherein the clamp installation assembly comprises a second actuator and a second arm, wherein the second arm pivots around a second pivot axis in response to extending the second actuator, and wherein the clamp installation assembly moves toward a well center in response to pivoting the second arm about the second pivot axis.

4. The clamp installation system of claim 1, wherein the clamp head is a part of a clamp installation assembly coupled to the manipulator assembly, wherein the clamp installation assembly comprises:

a draw actuator of a draw mechanism, the draw actuator configured to retract, which causes the draw mechanism to engage the tubular string; and a scissor assembly configured to extend in response to the draw actuator retracting, which causes the axially-retained control line clamp to be pressed into engagement with the coupling.

5. A method, comprising:

receiving a clamp into a clamp head of a clamp installation assembly;

moving the clamp head into proximity of a tubular string having a coupling between two tubulars;

pressing the clamp into engagement with the tubular string using the clamp installation assembly, wherein the clamp comprises first and second sections that are initially separated axially apart, and wherein, when pressed into engagement with the tubular, the first and second sections are at least partially on opposite axial sides of the coupling;

driving the first and second sections of the clamp toward one another using the clamp head;

releasing the clamp from the clamp head; and moving the clamp head away from the tubular string.

6. The method of claim 5, wherein pressing the clamp into engagement with the tubular string comprises actuating a draw actuator of a draw mechanism of the clamp installation assembly, and wherein actuating the draw actuator comprises retracting the draw actuator, which causes the draw mechanism to engage the tubular string.

7. The method of claim 6, wherein actuating the draw actuator also causes a scissor assembly of the clamp installation assembly to extend, and wherein the clamp is pressed into engagement with the coupling in response to the scissor assembly extending.

8. The method of claim 5, wherein the clamp comprises a shoulder feature positioned on either end of the coupling.

9. A method for installing a clamp, the method comprising:

actuating a device into a first position, wherein a clamp installation assembly of the device faces away from a tubular string when the device is in the first position;

running the tubular string into a wellbore, wherein the tubular string is run while the device is in the first position;

deploying a control line along the tubular string using a control line manipulating arm, wherein a coupling connects adjacent tubulars of the tubular string together, and wherein the control line runs along and past the coupling;

loading the clamp into a clamp head of the clamp installation assembly;

actuating the device from the first position into a second position;

actuating the device from the second position into a third position;

moving the clamp head vertically along the tubular string to at least partially align the clamp head with the coupling;

actuating a draw actuator of a draw mechanism of the clamp installation assembly, wherein actuating the draw actuator comprises retracting the draw actuator, which causes the draw mechanism to engage the tubular string;

securing the clamp onto the coupling, wherein the clamp is secured by adducting two sections of the clamp head together; and moving the clamp installation assembly away from the tubular string once the clamp is secured to the coupling.

10. The method of claim 9, wherein the device is secured to a base of the control line manipulating arm, wherein the control line manipulator arm comprises a control line positioner which defines a channel through which the control line is received, and wherein the channel is circumferentially aligned with notches formed in the clamp to position of the control line in a circumferential direction.

11. The method of claim 9, further comprising receiving the tubular string between the clamp head and a roller of the draw mechanism of the clamp installation assembly when the device is in the third position.

12. The method of claim 9, wherein the device is actuated by extending a first actuator of the device, wherein a first arm of the device pivots about a first pivot axis in response to extending the first actuator, and wherein the clamp installation assembly moves in response to pivoting the first arm about the first pivot axis.

13. The method of claim 12, wherein the device is actuated by extending a second actuator of the device, wherein a second arm of the device pivots about a second pivot axis in response to extending the second actuator, and wherein the clamp installation assembly moves toward a well center in response to pivoting the second arm about the second pivot axis.

14. The method of claim 13, further comprising actuating the device from the third position back to the first position after the clamp installation assembly is moved away from the tubular string, wherein the device is actuated by retracting the first and second actuators, and wherein the clamp installation assembly moves until it is facing away from the tubular string in response to retracting the first and second actuators.

15. The method of claim 9, wherein moving the clamp head vertically occurs in response to actuating a vertical adjustment actuator of the clamp installation assembly.

16. The method of claim 15, wherein actuating the draw actuator also causes a scissor assembly of the clamp installation assembly to extend, and wherein the clamp is pressed into engagement with the coupling in response to the scissor assembly extending.

17. The method of claim 16, wherein the clamp is secured while the clamp is pressed into engagement with the coupling.

18. The method of claim 16, wherein the clamp comprises a shoulder feature positioned on either end of the coupling.

19. The method of claim 16, wherein the scissor assembly is biased toward retracting by a counterweight.

20. The method of claim 19, wherein moving the clamp installation assembly comprises actuating the draw actuator, wherein actuating the draw actuator comprises extending the draw actuator, which then allows the counterweight to cause the scissor assembly to retract, and wherein the clamp head moves away from the tubular string in response to the scissor assembly retracting.

* * * * *